US007367642B2

(12) United States Patent
Ouchi et al.

(10) Patent No.: US 7,367,642 B2
(45) Date of Patent: May 6, 2008

(54) IMAGE-RECORDING DEVICE

(75) Inventors: Tetsuya Ouchi, Nagoya (JP); Jun Morikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 82 days.

(21) Appl. No.: 11/277,465

(22) Filed: Mar. 24, 2006

(65) Prior Publication Data

US 2006/0221111 A1 Oct. 5, 2006

(30) Foreign Application Priority Data

Mar. 29, 2005 (JP) ..... 2005-093582
Mar. 29, 2005 (JP) ..... 2005-094312

(51) Int. Cl.
*B41J 29/38* (2006.01)

(52) U.S. Cl. ..... 347/14; 347/19

(58) Field of Classification Search ..... 347/19, 347/101, 14
See application file for complete search history.

(56) References Cited

U.S. PATENT DOCUMENTS 5,701,145 A 12/1997 Ninomiya et al.
6,247,787 B1 * 6/2001 Giere et al. ..... 347/40
6,945,721 B2 9/2005 Sato
7,086,714 B2 * 8/2006 Endo ..... 347/16
2003/0137548 A1 7/2003 Bjune
2004/0119224 A1 6/2004 Otsuka
2004/0212648 A1 10/2004 Arakawa et al.
2006/0055718 A1 3/2006 Endo et al.

FOREIGN PATENT DOCUMENTS

EP 1535740 A1 6/2005
JP 2004 0182361 7/2004
WO 2004011262 A1 2/2004

OTHER PUBLICATIONS

European Patent Office, European Search Report for Related EP Application No. 06251588 dated Aug. 29, 2006.

* cited by examiner

*Primary Examiner*—Thinh Nguyen
(74) *Attorney, Agent, or Firm*—Baker Botts L.L.P.

(57) ABSTRACT

An image-recording device includes a conveying portion, a carriage, a recording head, a sensor, and an edge-detecting portion. The carriage reciprocates along a scanning direction. The recording head is supported on the carriage. The sensor is supported on the carriage at a position shifted from the recording head in the scanning direction and upstream of the recording head in the conveying direction, the sensor being capable of detecting presence of the recording medium. The edge-detecting portion controls the sensor to detect at least one of a leading edge and a trailing edge of a recording medium.

18 Claims, 22 Drawing Sheets

IMAGE-RECORDING DEVICE

CROSS REFERENCE TO RELATED APPLICATIONS

This application claims priority from Japanese Patent Application No. 2005-093582 filed Mar. 29, 2005 and Japanese Patent Application No. 2005-094312 filed Mar. 29, 2005. The entire content of each of these priority applications is incorporated herein by reference.

TECHNICAL FIELD

The disclosure relates to an image-recording device having a carriage in which are supported a recording head and a sensor of edge-detecting portion for detecting a leading edge and a trailing edge of a recording medium.

BACKGROUND

One type of conventional image-recording device referred to as a serial printer is an inkjet printer. This type of inkjet printer includes a recording head having actuators configured of piezoelectric elements or electrostrictive elements that bend in response to an inputted signal, or heating elements that locally boil the ink to generate pressure. The recording head supplies ink to the actuators, which apply pressure to the ink based on an inputted signal for ejecting ink droplets. The inkjet printer also includes a carriage on which the recording head is supported for reciprocating in a direction orthogonal to the conveying direction of a recording paper. The carriage is scanned once each time the recording paper is conveyed a prescribed line feed amount, during which time the recording head ejects ink droplets based on inputted signals to record an image on the recording paper.

This type of inkjet printer detects edges of the recording paper in order to align the image accurately with respect to the recording paper. It is important that these inkjet printers detect both width edges of the recording paper accurately, particularly when performing edge-to-edge borderless printing.

One such method for detecting the edges of the recording paper is disclosed in Japanese unexamined patent application publication No. 2004-182361. This inkjet printer has a carriage, and an optical sensor mounted on the carriage. The optical sensor includes a light-emitting element for irradiating light onto the recording paper, and a light-receiving element for receiving light reflected off the recording paper. The light-emitting element irradiates light onto the recording paper as the carriage moves in a scanning motion so that the optical sensor can detect the presence of the recording paper based on the amount of reflected light received by the light-receiving element.

SUMMARY

Attributes that are desirable in image-recording devices, such as inkjet printers, are high-accuracy printing and high-speed printing. One means for achieving high-speed printing is through continuous feeding of the recording paper. In a normal printing process, the recording paper is fed from a paper tray and conveyed along a conveying path to a carriage. A recording head mounted on the carriage then records an image on the recording paper, and the recording paper is discharged onto a discharge tray. After the recording paper is discharged, the next sheet of recording paper is fed from the paper tray.

In continuous feeding, on the other hand, the next sheet of recording paper has already been supplied from the paper tray onto the conveying path by the time the current sheet of recording paper is discharged onto the discharge tray. Accordingly, both the current sheet and the next sheet are conveyed simultaneously on the conveying path and are separated by a prescribed distance in the conveying direction. This method can reduce the time required for conveying the recording paper when recording images on a plurality of sheets of recording pacer, thereby increasing the speed of the image-recording process.

However, when performing continuous feeding, it is necessary to detect with accuracy the distance between a preceding sheet and a subsequent sheet of recording paper, that is, a gap between sheets. For example, it is necessary to detect the position of the beading edge of a sheet of recording paper in order to accurately align the image on the recording paper, and to detect the positions of both the leading edge and trailing edge of the recording paper with accuracy when performing borderless printing. Further, if a paper jam occurs, the image-recording device must determine whether the recording head was recording on the previous sheet or the subsequent sheet of recording paper at the time of the paper jam in order to determine which image data to reprint after the paper jam has been cleared. Further, since the positions of the optical sensor for detecting the edges of the recording paper and the recording head on the carriage differ, the image-recording device must determine whether the sheet of recording paper whose edges have been detected by the optical sensor is the same sheet of recording paper on which the recording head was recording an image.

In view of the foregoing, it is an object of the invention to provide an image-recording device for easily and accurately detecting the leading edge and trailing edge of a recording paper.

In order to attain the above and other objects, the invention provides an image-recording device. The image-recording device includes a conveying portion, a carriage, a recording head, a sensor and an edge-detecting portion. The conveying portion conveys a recording medium in a conveying direction. The carriage reciprocates along a scanning direction orthogonal to the conveying direction. The recording head is supported on the carriage. The recording head performs recording operations for recording an image on the recording medium. The sensor is supported on the carriage at a position shifted from the recording head in the scanning direction and upstream of the recording head in the conveying direction. The sensor is capable of detecting presence of the recording medium. The edge-detecting portion controls the sensor to detect at least one of a leading edge and a trailing edge of a recording medium.

In order to attain the above and other objects, the invention provides an image-recording device The image-recording device includes a conveying portion, a carriage, a recording head, a sensor, a left-and-right-edge detecting portion, a leading-and-trailing-edge detecting portion, a leading-and-trailing-edge detecting portion, a memory, a recording medium determining portion, and a controlling portion. The conveying portion conveys a recording medium in a conveying direction. The carriage reciprocates along a scanning direction orthogonal to the conveying direction. The recording head is supported on the carriage. The recording head performs recording operations for recording an image on the recording medium. The sensor is supported on the carriage at a position shifted from the recording head in the scanning direction and upstream of the recording head in the conveying direction. The sensor is capable of detecting presence of the recording medium. The left-and-right-edge detecting portion controls the carriage to move in the scanning direction while detecting left and right edges of a recording medium based on a detection signal from the sensor. The leading-and-trailing-edge detecting portion controls the carriage to be placed in a standby position, at which position the recording head is outside an area through which the recording medium passes and the sensor is within the area through which the recording medium passes. The leading-and-trailing-edge detecting portion detects leading and trailing edges of a recording medium based on a detection signal from the sensor when the conveying portion conveys the recording medium. The memory stores a left and right edge data indicating positions of the left and right edge of the recording medium detected by the left-and-right-edge detecting portion, distinguishing between a left and right edge data of a currently recording medium and a left and right edge data of a next recording medium on which an image is to be recorded. The recording medium determining portion determines, after the leading-and-trailing-edge detecting portion detects the trailing edge of the currently recording medium, whether the recording medium associated with the left and right edge data is the next recording medium, based on the detection of the leading edge for the next recording medium. The controlling portion controls the recording head to perform an image-recording operation on each recording medium based on the left and right edge data stored in the memory.

BRIEF DESCRIPTION OF THE DRAWINGS

Illustrative aspects in accordance with the invention will be described in detail with reference to the following figures wherein.

DETAILED DESCRIPTION

Figure 1:
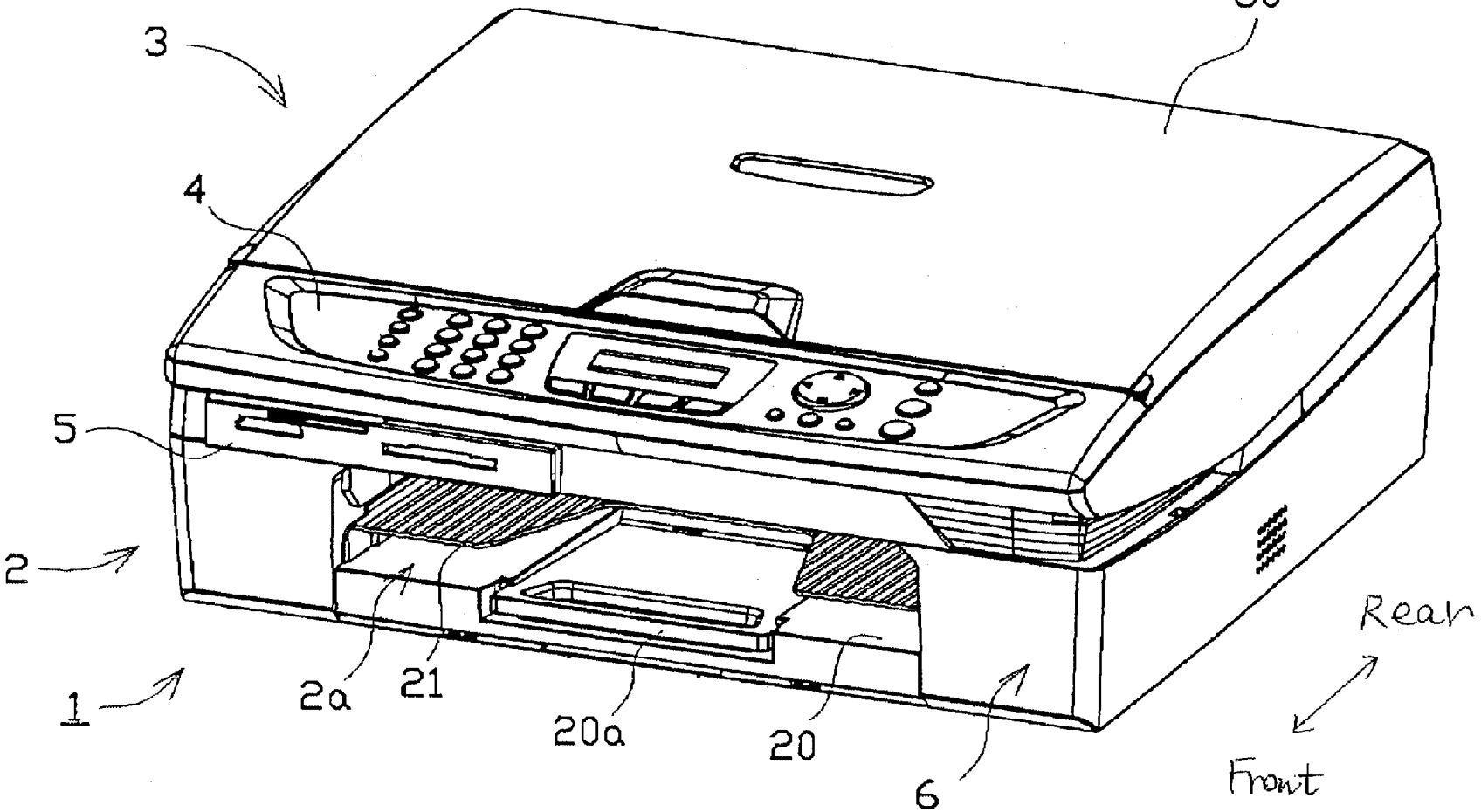
FIG. 1 is a perspective view showing the outer structure of a multifunction device according to illustrative aspects of the invention.

A image-recording device according to some aspects of the invention will be described while referring to the accompanying drawings wherein like parts and components are designated by the same reference numerals to avoid duplicating description.

FIG. 1 shows the external appearance of a multifunction device 1 according to some aspects of the invention. The multifunction device 1 is integrally provided with a printing unit 2 in the lower section, and a scanning unit 3 in the upper section, and possesses a printer function, scanner function, copier function, and facsimile function. The printing unit 2 in the multifunction device 1 corresponds to the image-recording device of the present invention, and all functions other than the printer function are arbitrary. Therefore, the present invention ray be applied to a single-function. printer having no scanning unit 3 and, hence, no scanner function or copier function.

When implementing the image-recording device according to the present invention as a multifunction device, the device nay be compact as the multifunction device 1 preferably, or may be a larger device including a plurality of paper cassettes and an automatic document feeder (ADF). Further, the present invention is primarily connected to a computer (not shown) for recording text and images on a recording paper based on text or image data transferred from the computer. However, the multifunction device 1 may also be connected to an external device such as a digital camera and may record image data inputted from the digital camera on a recording paper. Also, the multifunction device 1 may be loaded with a memory card or other storage medium and may be capable of recording image data and the like stored on the storage medium on a recording paper. The structure of the multifunction device 1 described below is merely an example of the image-recording device according to the present invention, and it should be apparent that this structure can be modified appropriately within the scope of the present invention.

Figure 2:
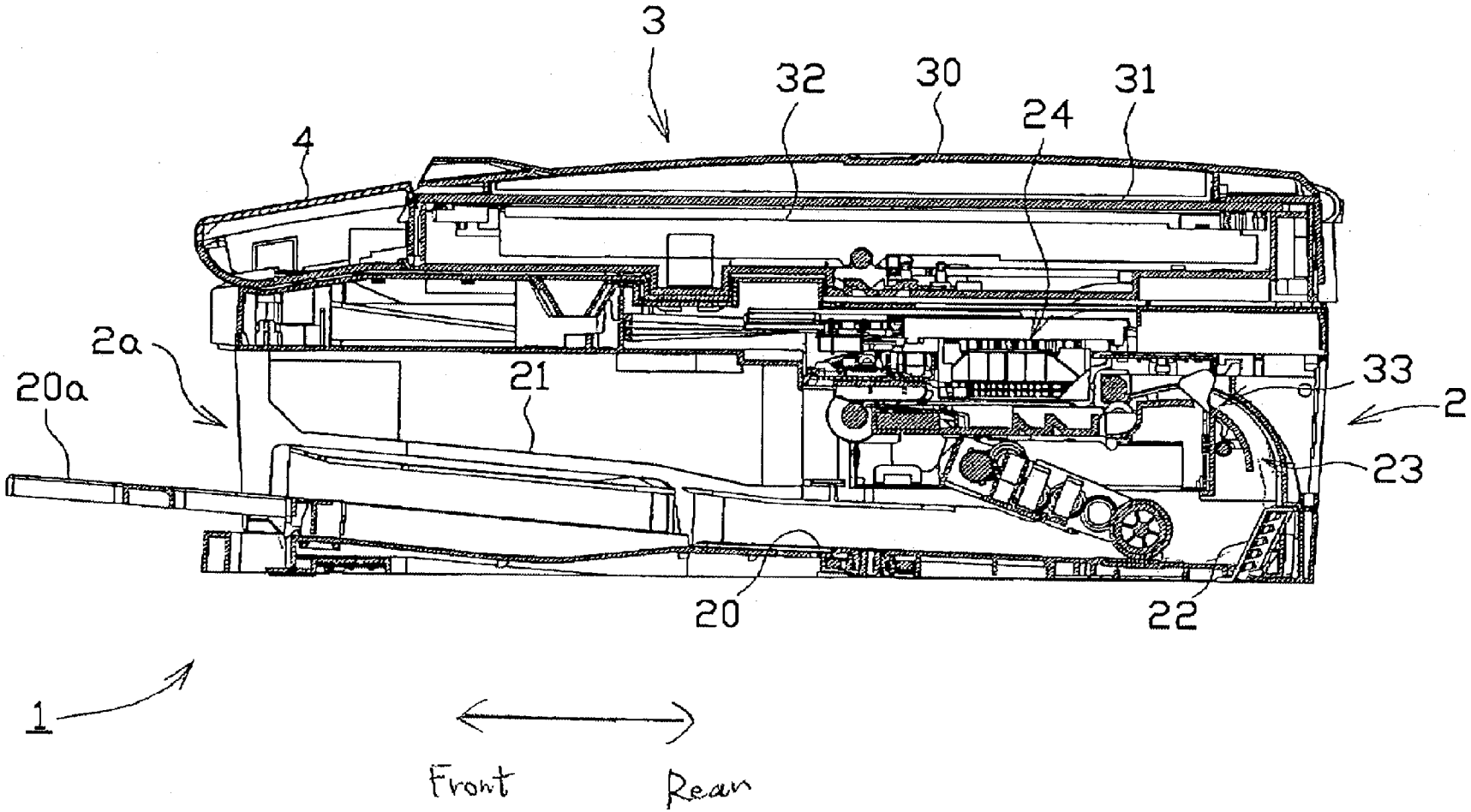
FIG. 2 is a side cross-sectional view showing the internal structure of the multifunction device according to illustrative aspects of the invention.

As shown in FIG. 1, the multifunction device 1 is substantially shaped as a thin rectangular parallelepiped with greater width and depth dimensions than the height dimension. The printing unit 2 provided in the lower section of the multifunction device 1 has an opening 2*a* formed in the front surface thereof. A paper tray 20 and a discharge tray 21 are stacked vertically as two levels in the opening 2*a* and are partially exposed therefrom. The paper tray 20 is capable of accommodating a recording paper of various sizes as large as the A4 size and including the B5 size and postcard size. The paper tray 20 includes a slidable tray 20*a* that can be pulled outward when needed, as shown in FIG. 2, to expand the surface area of the tray. Recording paper accommodated in the paper tray 20 is supplied into the printing unit 2 to undergo a desired image-recording process, and is subsequently discharged onto the discharge tray 21.

The scanning unit 3 disposed in the upper section of the multifunction device 1 is a flatbed scanner. As shown in FIGS. 1 and 2, the multifunction device 1 includes an original cover 30 on the top thereof that is capable of opening and closing, and a platen glass 31 and an image sensor 32 disposed below the original cover 30. The platen glass 31 functions to support an original document when an image on the document is being scanned. The image sensor 32 is disposed below the platen glass 31 and is capable of scanning in the width direction of the multifunction device 1, wherein the main scanning direction of the image sensor 32 is the depth direction of the multifunction device 1.

A control panel 4 is provided on the top front surface of the multifunction device 1 for operating the printing unit 2 and scanning unit 3. The control panel 4 is configured of various operating buttons and a liquid crystal display. The multifunction device 1 operates based on operating instructions inputted through the control panel 4 and, when connected to a computer, operates based on instructions that the computer transmits through a printer driver. A slot section 5 in which various small memory cards or other storage media can be inserted is provided in the upper left section of the multifunction device 1 on the front surface thereof. A user can input operating instructions via the control panel 4 to read image data stored on a memory card that is inserted into the slot section 5 and to display the image data on the liquid crystal display, and can further input instructions to record a desired image on a recording paper using the printing unit 2.

Next, the internal structure of the multifunction device 1, and particularly the structure of the printing unit 2, will be described with reference to FIGS. 2 through 9. As shown in FIG. 2, a sloped separating plate 22 is disposed near the rear side of the paper tray 20 provided in the lower section of the multifunction device 1 for separating recording paper stacked in the paper tray 20 and guiding the separated paper. A conveying path 23 leads upward from the sloped separating plate 22, curves toward the front of the multifunction device 1, and extends in the rear-to-front direction therefrom. The conveying path 23 passes an image-recording unit 24 and leads to the discharge tray 21. Hence, the conveying path 23 guides recording paper conveyed from the paper tray 20 along a U-shaped path that curves upward and back in the opposite direction to the image-recording unit 24. After the image-recording unit 24 has recorded an image on the paper, the paper continues along the conveying path 23 and is discharged onto the discharge tray 21.

Figure 3:
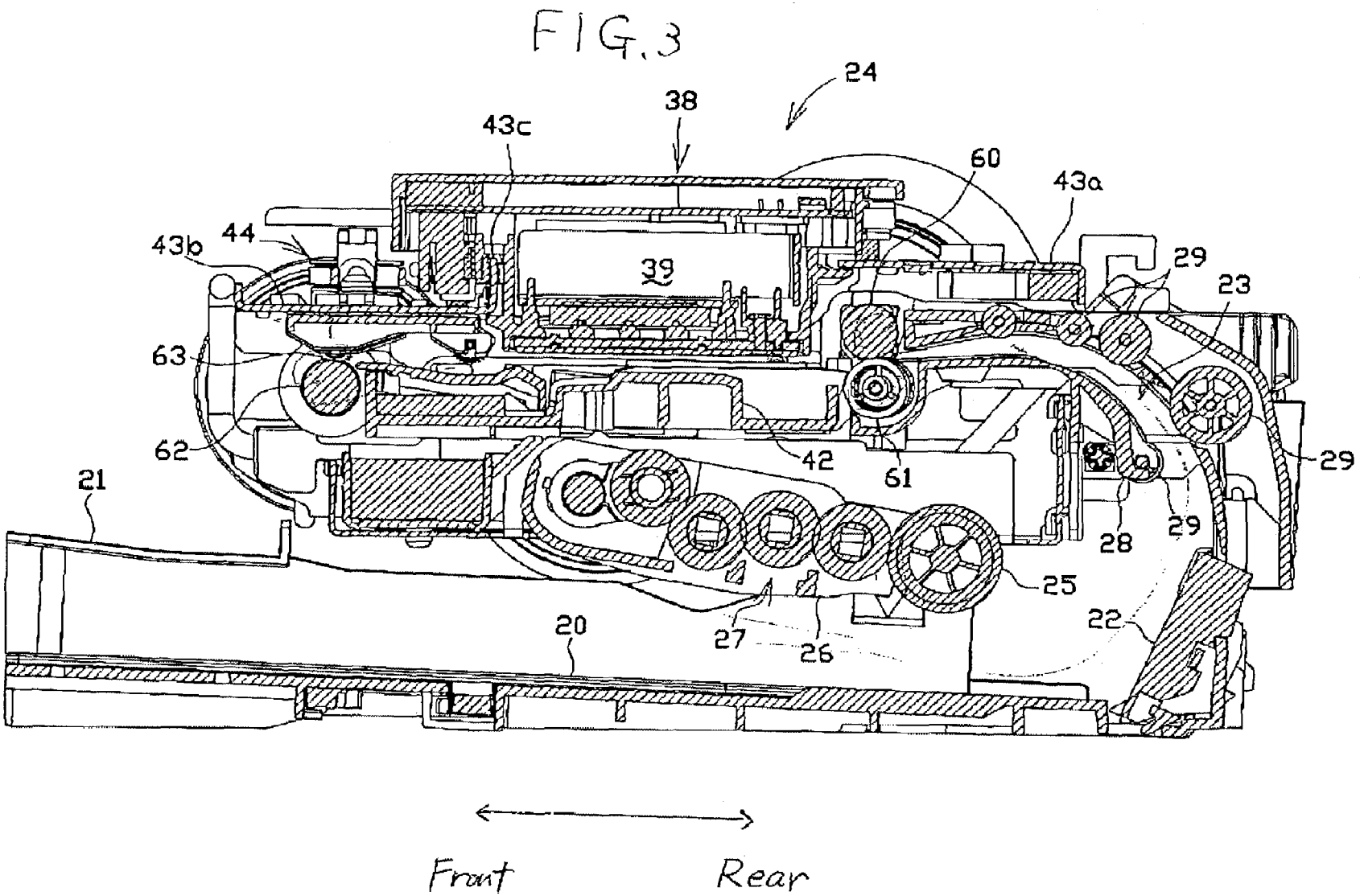
FIG. 3 is an enlarged cross-sectional view showing the primary structure of a printing unit.

As shown in FIG. 3, a feeding roller 25 is disposed above the paper tray 20 for separating paper accommodated in the paper tray 20 and supplying the paper onto the conveying path 23 one sheet at a time. The feeding roller 25 is supported on an end of a feeding arm 26 that is capable of moving up and down to separate from or contact the paper tray 20. A drive transmitting mechanism 27 provided in the feeding arm 26 and including a plurality of engaged gears transmits a driving force from a linefeed motor 71 (see FIG. 9) to the feeding roller 25 in order to rotate the feeding roller 25.

The feeding arm 26 is disposed so as to be able to pivot up and down about a base end. In a standby state, the feeding arm 26 is urged upward by a feeding clutch, spring, and the like (not shown). The feeding arm 26 is pivoted downward when feeding the recording paper. Specifically, when the feeding arm 26 is pivoted downward, the feeding roller 25 supported on the end of the feeding arm 26 contacts the surface of the recording paper in the paper tray 20 with pressure. As the feeding roller 25 rotates in this position, a frictional force generated between the surface of the feeding roller 25 and the recording paper conveys the topmost sheet of the recording paper toward the sloped separating plate 22. The leading edge of this sheet contacts the sloped separating plate 22 and is guided upward by the sloped separating plate 22 onto the conveying path 23. In some cases, when the feeding roller 25 is conveying the topmost sheet of recording paper, friction or static electricity between the topmost sheet and the underlying sheet causes the underlying sheet to be conveyed together with the topmost sheet. However, the underlying sheet is restrained when contacting the sloped separating plate 22.

Excluding the section in which the image-recording unit 24 and the like are provided, the conveying path 23 is configured of an outer guide surface and an inner guide surface that oppose each other with a prescribed gap formed therebetween. In the section of the conveying path 23 near the rear surface of the multifunction device 1, for example, the outer guide surface may be formed integrally with a frame of the multifunction device 1, while the inner guide surface may be configured of a guide member 28 fixed inside the frame. Various conveying rollers 29 are rotatably provided along the conveying path 23 and particularly in the curved region of the conveying path 23. The surfaces of the conveying rollers 29 are exposed from the outer guide surface or inner guide surface, and the axes of the conveying rollers 29 extend in the width direction of the conveying path 23. These conveying rollers 29 facilitate the smooth conveyance of recording paper when the paper contacts the guide surfaces in the curved region of the conveying path 23.

Figure 4:
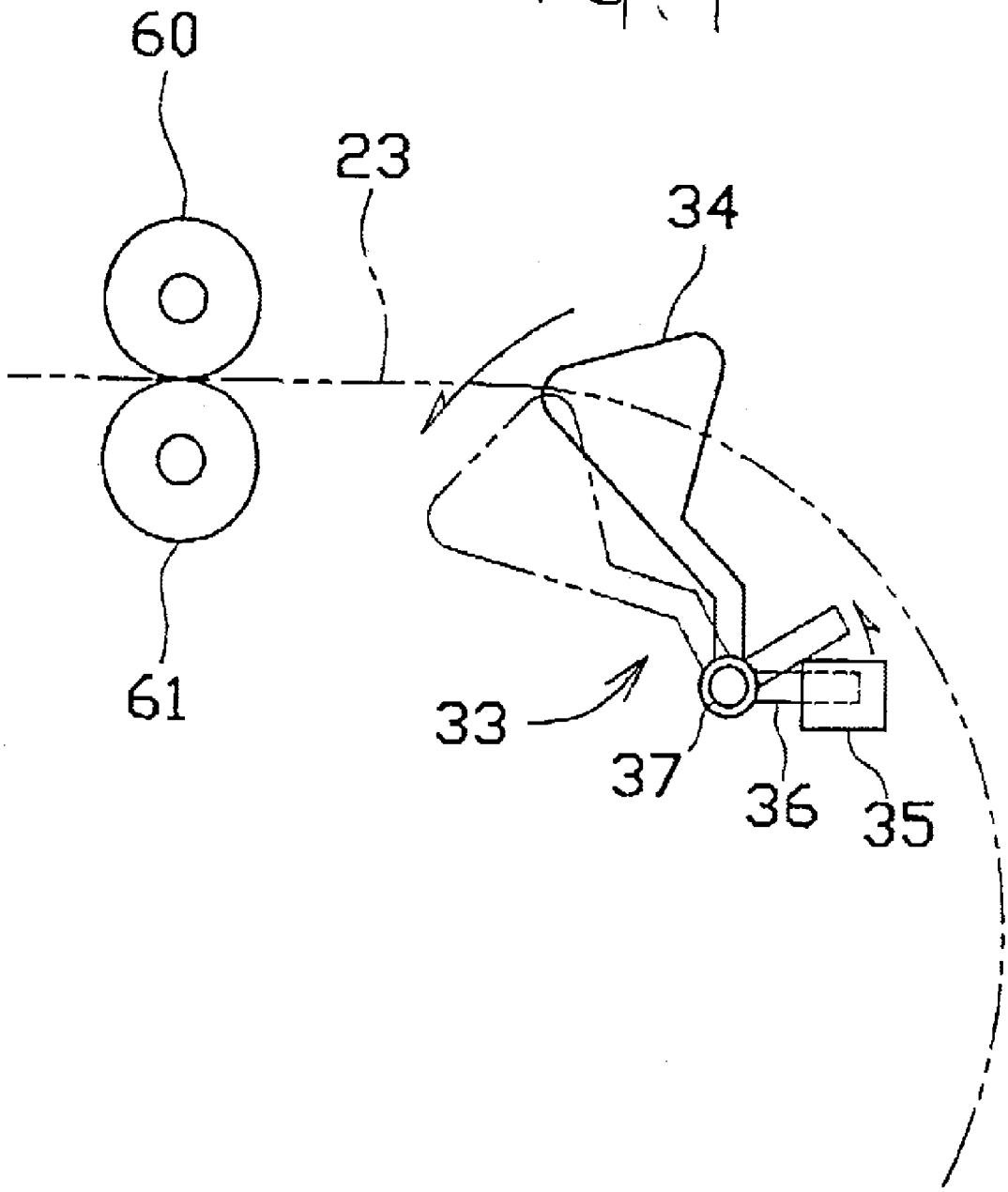
FIG. 4 is an enlarged view of a registration sensor.

A registration sensor 33 is disposed on the conveying path 23 upstream of the image-recording unit 24 after the U-shaped section of the conveying path 23. As shown in FIGS. 2 and 4, the registration sensor 33 includes a sensor arm 34 that protrudes into the conveying path 23 and rotates to retract from the conveying path 23 when contacted by a sheet of recording paper conveyed along the conveying path 23; and a photointerrupter 35 for detecting the rotation of the sensor arm 34.

The sensor arm 34 is rotatably provided about a shaft 37 and is integrally formed with a shielding part 36 that is detected by the photointerrupter 35. The sensor arm 34 s elastically urged in the clockwise direction in FIG. 4 by a spring or the like (not shown), that is, the sensor arm 34 is urged to a position protruding into the registration sensor 33. Hence, when an external force is not being applied to the sensor arm 34, the sensor arm 34 protrudes into the conveying path 23 and the shielding part 36 is positioned between the light-emitting element and light-receiving element of the photointerrupter 35, as shown in FIG. 4. Consequently, the shielding part 36 interrupts light transmission in the photointerrupter 35, turning the registration sensor 33 off. However, when the recording paper is conveyed along the conveying path 23 and the leading edge of the paper contacts the sensor arm 34, this contact begins to rotate the sensor arm 34 and pushes the sensor arm 34 out of the conveying path 23. Since the shielding part 36 rotates together with the sensor arm 34, the shielding part 36 is retracted from its position between the light-emitting element and light-receiving element of the photointerrupter 35. Consequently, the shielding part 36 no longer interrupts light transmission in the photointerrupter 35, turning the registration sensor 33 on. As the registration sensor 33 turns on and off, it is possible to detect the passage of the recording paper upstream of the image-recording unit 24.

As shown in FIG. 3, the image-recording unit 24 is disposed downstream of the registration sensor 33 on the conveying path 23. The image-recording unit 24 includes a carriage 38 that reciprocates in the main scanning direction, and a recording head 39 mounted in the carriage 38. The recording head 39 ejects microdroplets of ink in the colors cyan (C), magenta (M), yellow (Y), and black (Bk) to form images on the recording paper. The ink is supplied from ink tanks 40 (see FIG. 5) that are provided in the multifunction device 1 separately from the recording head 39 via ink supply tubes 41 (see FIG. 5). The recording head 39 mounted in the carriage 38 records images on the recording paper being conveyed over a platen 42 described later as the carriage 38 is scanned.

Figure 5:
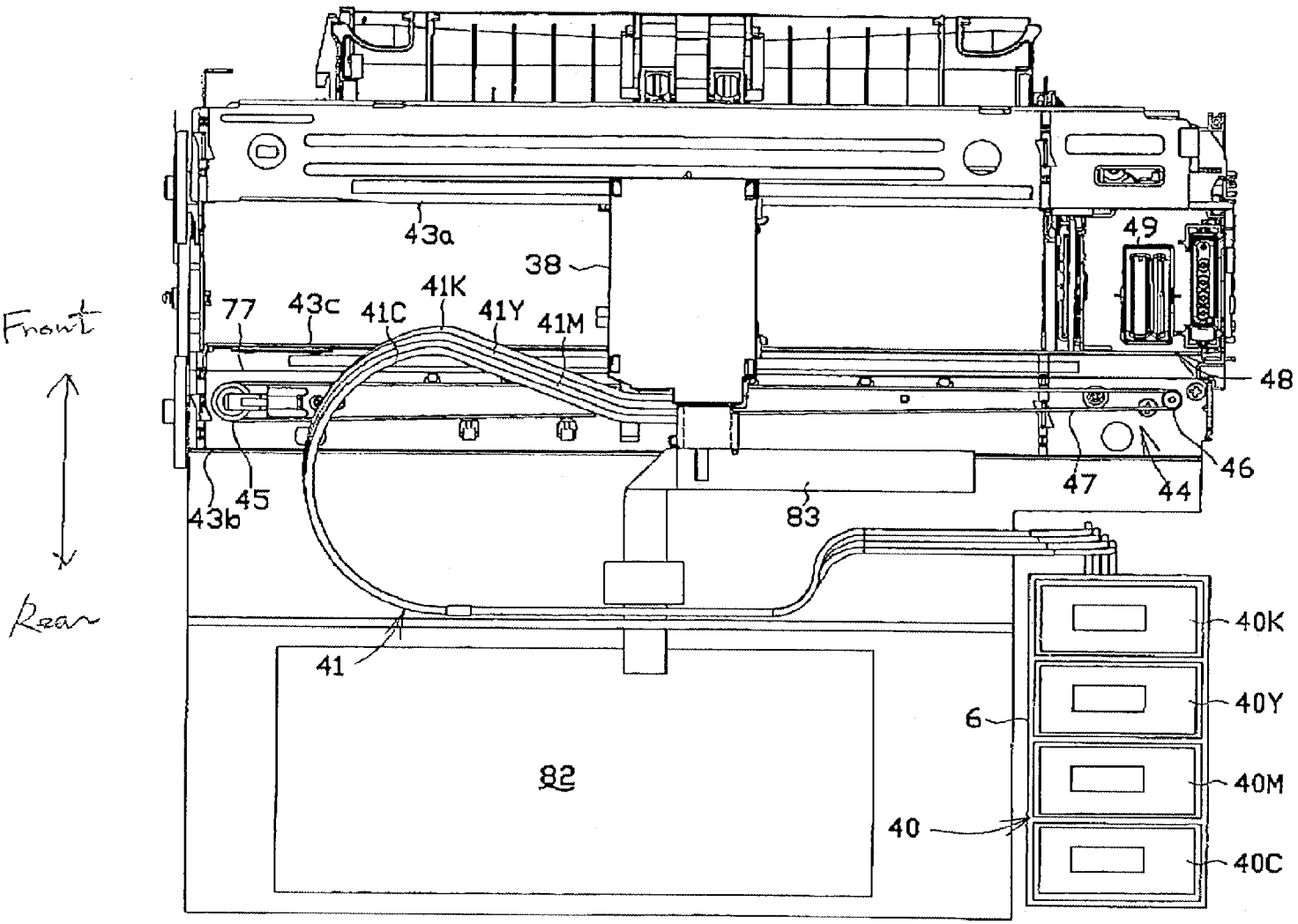
FIG. 5 is a plan view showing the general construction around a carriage.

More specifically, a pair of guide rails 43*a* and 43*b* are disposed above the conveying path 23 at a prescribed distance from each other in the conveying direction of the recording paper, as shown in FIG. 5. The guide rails 43*a* and 43*b* extend in the width direction of the conveying path 23. The carriage 38 is slidably disposed across both the guide rails 43*a* and 43*b*. The guide rail 43*a* is disposed upstream of the guide rail 43*b* in the paper-conveying direction. The guide rail 43*a* is plate-shaped with a dimension in the width direction of the conveying path 23 greater than the scanning path of the carriage 38. The top surface of the guide rail 43*a* slidably supports the upstream end of the carriage 38.

The guide rail 43*b* disposed on the downstream side is also plate-shaped with a dimension in the width direction of the conveying path 23 substantially the same as that of the guide rail 433*a*. The guide rail 43*b* has an edge part 43*c* that is bent upward at substantially a right angle for supporting the downstream end of the carriage 38. The carriage 38 is slidably supported on the top surface of the guide rail 43*b* and grips the edge part 43*c* with a roller or the like (not shown). Hence, the carriage 38 is slidably supported on the guide rails 43*a* and 43*b* and is capable of reciprocating in the width direction of the conveying path 23 with the edge part 43*c* of the guide rail 43*b* serving as a positional reference. Here, a sliding member for reducing friction is preferably provided on regions of the carriage 38 that contact the top surfaces of the guide rails 43*a* and 433*b*.

As shown in FIG. 5, a belt drive mechanism 44 is provided on the top surface of the guide rail 43*b*. the belt drive mechanism 44 s configured of a drive pulley 45 and a follow pulley 46 disposed near widthwise ends of the conveying path 23, and an endless timing belt 47 stretched around the drive pulley 45 and follow pulley 46 and having teeth on the inside surface thereof. A carriage motor 73 (see FIG. 9) inputs a driving force into the shaft of the drive pulley 45 for rotating the drive pulley 45. The rotation of the drive pulley 45 causes the timing belt 47 to move in a circuit. Although the timing belt 47 is an endless belt preferably, a belt with ends may also he used by fixing both ends to the carriage 38.

The carriage 38 is fixed to the timing belt 47 so that circular movement of the timing belt 47 causes the carriage 38 to reciprocate over the guide rails 43*a* and 43*b* using the edge part 43*c* as reference. The recording head 39 is mounted in the carriage 38 having this construction so that the recording head 39 also reciprocates in the width direction of the conveying path 23. Here, the width direction of the conveying path 23 is the main scanning direction. A strip-like linear encoder 77 is provided along the edge part 43*c*. The reciprocating motion of the carriage 38 can be controlled based on the position of the linear encoder 77 detected with a photointerrupter.

As shown in FIG. 3, the platen 42 is disposed on the bottom of the conveying path 23 opposing the recording head 39. The platen 42 spans a central portion among the reciprocating range of the carriage 38 through which the recording paper passes. The width of the platen 42 is sufficiently larger than the maximum width of recording paper that can be conveyed in the multifunction device 1 so that both widthwise edges of the recording paper pass over the platen 42. The toga surface of the platen 42 that supports the recording paper is preferably of a color having different reflectance from the color of the recording paper, which is generally white, and therefore is preferably black.

As shown in FIG. 5, a maintenance unit including a purging mechanism 48 and a waste ink today (not shown) are provided in a region through which the recording paper does not pass, that is, in a region outside the image-recording range of the recording head 39. The purging mechanism 48 functions to draw out air bubbles and foreign matter from nozzles 53 (see FIG. 8) and the like in the recording head 39. The purging mechanism 48 includes a cap 49 for covering the nozzle surface of the recording head 39, a pump mechanism (not shown) connected to the recording head 39 via the cap 49, and a moving mechanism (not shown) for moving the cap 49 to contact or separate from the nozzle surface of the recording head 39. When an operation is performed to remove air bubbles and the like from the recording head 39, the carriage 38 is moved so that the recording head 39 is positioned above the cap 49. Subsequently, the moving mechanism moves the cap 49 upward against the bottom surface of the recording head 39 so as to form a seal over ink ejection holes 53*a* (see FIG. 6) formed in this bottom surface. The pump mechanism coupled to the cap 49 then draws out ink from the nozzles 53 and the like in the recording head 39.

While not shown in the drawings, the waste ink tray is also disposed outside of the image-recording range, but within the moving range of the carriage 38 for receiving ink that has been flushed out of the recording head 39. This maintenance unit can perform such maintenance as removing air bubbles and mixed ink of different colors from the recording head 39. The structure of the maintenance unit, including the purging mechanism 48 and the waste ink tray, is arbitrary in the present invention.

As shown in FIG. 1, the ink tanks 40 are accommodated in an ink tank accommodating section 6 disposed in the front left side (right side in FIG. 1) of the printing unit 2. As shown in FIG. 5, the ink tanks 40 are provided separately from the carriage 38 and the recording head 39 and supply ink to the carriage 38 via the ink supply tubes 41.

The ink tanks 40 include four ink tanks 40C, 40M, 40Y, and 40K accommodating ink of the respective colors cyan (C), magenta (M), yellow (Y), and black (Bk). The four ink tanks 40 are mounted at prescribed positions in the ink tank accommodating section 6. While not shown in detail in the drawings, each of the ink tanks 40 has a cartridge structure with a casing formed of a synthetic resin that is filled with the respective color of ink. These cartridge type ink tanks 40 are detachably mounted in the ink tank accommodating section 6 from above. An opening is formed in the bottom surface of the casing for each ink tank 40 in order to supply the ink stored in the casing. The opening is sealed with a check valve. Joints for opening these check valves are provided in the ink tank accommodating section 6. After mounting the ink tanks 40 in the ink tank accommodating section 6, ink can be supplied through the openings in the bottom of the casing by opening the check valves.

Preferably, the multifunction device 1 performs image recording with four colors of ink. However, the image-recording device of the present invention is not particularly limited to the number of ink colors used. For example, it should be apparent that the number of ink tanks may be increased to perform image recording in six colors or eight colors. Further, the ink tanks 40 are not restricted to a cartridge type ink tank, but may be any construction that is appropriately filled with ink and that remains stationary inside the device.

As described above, ink is supplied from the ink tanks 40 mounted in the ink tank accommodating section 6 to the recording head 39 via the ink supply tubes 41. The ink supply tubes 41 include ink supply tubes 41C, 41Y, 41Y, and 41K provided independently or supplying ink of each color. The ink supply tubes 41 are tubes formed of synthetic resin and are flexible so as to be able to bend when the carriage 38 moves in a scanning motion. Although not shown in detail in the drawings, the opening in one end of each of the ink supply tubes 41 is connected to one of the joints provided in the ink tank accommodating section 6 at positions corresponding to each mounted ink tank. The ink supply tube 41C corresponds to the ink tank 40C and supplies cyan ink thereto. Similarly, the ink supply tubes 41M, 41Y, and 41K correspond to the ink tanks 40M, 40Y, and 40K and supply the corresponding ink colors magenta, yellow, and black thereto.

From the ink tank accommodating section 6, the ink supply tubes 41 are led along the width direction of the device to a position near the center thereof, at which position the ink supply tubes 41 are fixed to an appropriate member on the frame or the like. The section of the ink supply tubes 41 from the fixed part to the carriage 38 forms a U-shaped curve that is not fixed to the device frame or the like. This U-shaped section changes in shape as the carriage 38 reciprocates. Hence, as the carriage 38 moves toward one end (the left side in FIG. 4) in the reciprocating direction, the ink supply tubes 41 move in the same direction of the carriage 38 while flexing, so that the radius of the U-shaped curved portion of the ink supply tubes 41 grows smaller when the carriage 38 moves to the other end (right side) in the reciprocating direction, the ink supply tubes 41 move in the same direction while flexing, so that the radius of the curved portion grows larger.

Figure 6:
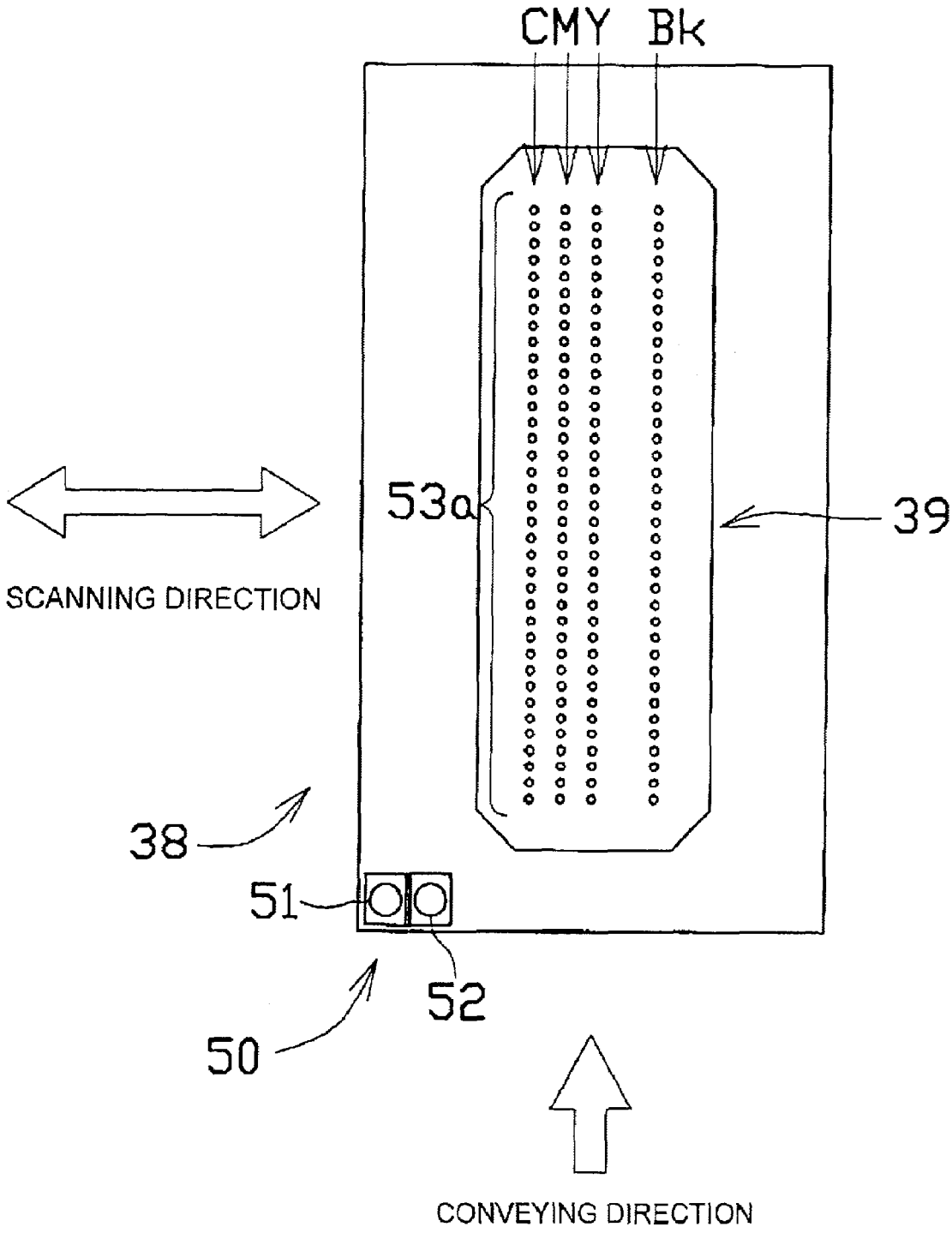
FIG. 6 is a bottom view showing the bottom surface of the carriage.
Figure 7:
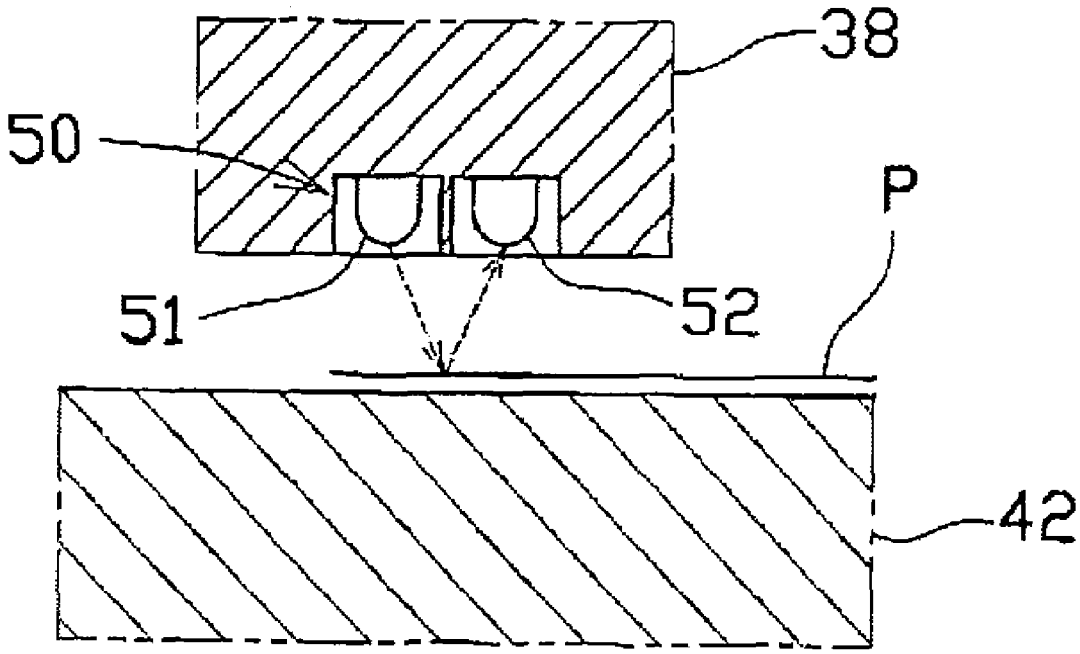
FIG. 7 is a partial cross-sectional view showing the cross-sectional structure of a media sensor.

As shown in FIG. 6, a media sensor 50 is mounted on the carriage 38 in addition to the recording head 39. The media sensor 50 is configured of a light-emitting element 51, such as an LED, and a light-receiving element 52, such as a photosensor, as shown in FIGS. 6 and 7. As illustrated in FIG. 7, the light-emitting element 51 of the media sensor 50 irradiates light toward the platen 42, while the light-receiving element 52 receives this reflected light. As described above, the top surface of the platen 42 is formed of a color having a different reflectance than a recording paper P, such as black. When the recording paper P is not present, the light-receiving element 52 receives light reflected off the platen 42, which has a Low reflectance and, hence, the detection value (AD value) of the media sensor 50 is low. However, when the recording paper P is present, the light-receiving element 52 receives light reflected off the recording paper P, which has a high reflectance and, hence, the detection value (AD value) of the media sensor 50 is high. As shown in FIG. 6, the media sensor 50 is mounted on an end of the carriage 38 in the scanning direction, that is, the media sensor 50 is supported on the carriage 38 at a position shifted from the recording head 39 in the scanning direction. The recording head 39 is supported on the carriage 38, upstream of the recording head 39 in the paper-conveying direction and reciprocates in the scanning direction together with the carriage 38.

As shown in FIG. 6, the ink ejection holes 53*a* are formed in the bottom surface of the recording head 39 in rows extending in the paper-conveying direction for each of the ink colors CMYBk. The pitch and number of the ink ejection holes 53*a* in the conveying direction is set appropriately with consideration for the resolution of the images to be recorded and the like. It is also possible to increase or decrease the number of rows of the ink ejection holes 53*a* to correspond to the number of ink colors.

Figure 8:
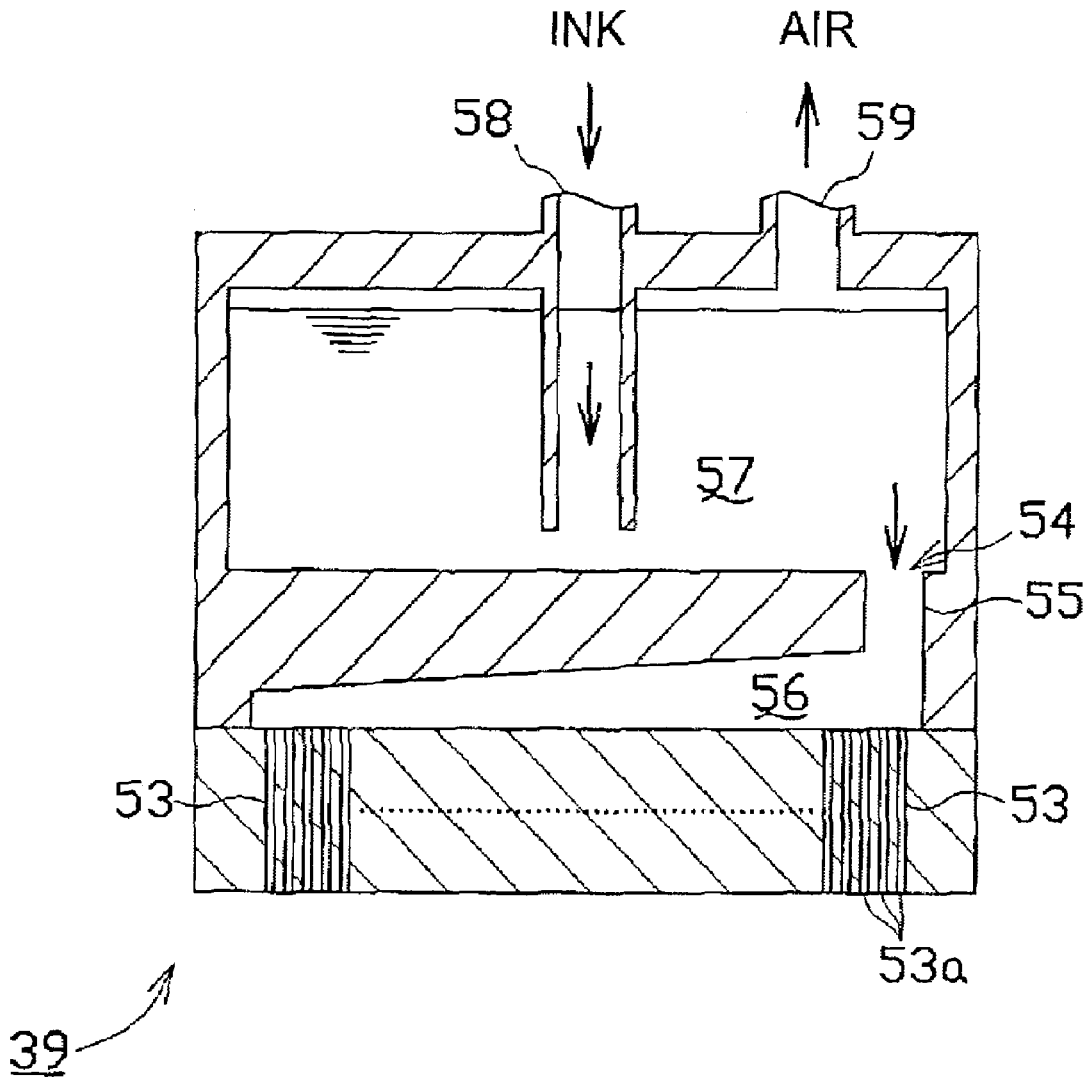
FIG. 8 is a cross-sectional view showing the internal structure of a recording head.

As shown on FIG. 8, the nozzles 53 are arranged in rows in the bottom section of the recording head 39, and the ink ejection holes 53*a* are formed as openings in the bottom surface of the recording head 39 at the lower ends of the nozzles 53. A manifold 54 is formed over the upper ends of the nozzles 53 and across all of the nozzles 53 for each respective ink color. Each manifold 54 includes a supply tube 55 formed on one end of the row of the nozzles 53, and a manifold chamber 56 formed across the top ends of the nozzles 53. Ink supplied through the supply tube 55 is distributed to each of the nozzles 53 via the manifold chamber 56.

The surface of the manifold chamber 56 opposite the nozzles 53 is sloped downward in the downstream direction of ink flow so that the cross-sectional area of the manifold chamber 56 grows smaller toward the downstream end. The side walls of the nozzles 53 are configured of a piezoelectric material, for example, as a mechanism for ejecting the ink distributed from the manifold 54 through the ink ejection holes 53*a* as ink droplets. In this case, the piezoelectric material deforms to eject an ink droplet. However, another mechanism known in the art may be employed.

A buffer tank 57 is provided above the manifold 54. As with the nozzles 53 and the manifold 54, the buffer tank 57 is provided for each color CMYBk. An ink supply opening 58 is formed in each buffer tank 57 for supplying ink to the buffer tank 57 from the respective ink tanks 40 via the ink supply tubes 41. With this construction, the ink is not supplied directly from the ink tanks 40 to the nozzles 53, but is temporarily stored in the buffer tank 57. In this way, it is possible to capture air bubbles produced in the ink when the ink flows through the ink supply tubes 41 and the like and prevent these air bubbles from entering the nozzles 53. Air bubbles captured in the buffer tank 57 are drawn out of the buffer tank 57 through an air bubble outlet 59 by a pump mechanism (not shown).

The buffer tank 57 is in fluid communication with the manifold chamber 56 via the supply tube 55. Hence, this construction forms an ink channel by which ink of the respective color supplied from the respective ink tank 40 flows to the respective nozzles 53 via the buffer tank 57 and manifold 54. In this way, ink of each color CMYBk supplied via these ink channels is subsequently ejected from the ink ejection holes 53*a* onto recording paper as ink droplets.

As shown in FIG. 3, a conveying roller 60 and a pinch roller 61 disposed in confrontation with the conveying roller 60 are provided on the upstream side of the image-recording unit 24 for receiving a sheet of paper conveyed along the conveying path 23 and, while pinching the paper therebetween, conveying the paper over the platen 42. A discharge roller 62 and an opposing spur roller 63 are disposed on the downstream side of the image-recording unit 24 for pinching the sheet of recording paper and conveying the sheet out of the printing unit 2 after the image-recording unit 24 has recorded an image thereon. The linefeed motor 71 transmits a driving force to the conveying roller 60 and discharge roller 62 for driving the conveying roller 60 and discharge roller 62 intermittently at prescribed line feed amounts. Rotation of the pinch roller 61 and discharge roller 62 is synchronized. Further, a rotary encoder 76 (see FIG. 9) is provided on the conveying roller 60. By detecting the rotary encoder 76 with a photointerrupter, it is possible to control the rotation of the conveying roller 60 and discharge roller 62.

The pinch roller 61 is urged to press against the conveying roller 60 with a prescribed force and is capable of rotating freely. When a sheet of paper is interposed between the conveying roller 60 and pinch roller 61, the pinch roller 61 pinches the recording paper against the conveying roller 60 while receding an amount equivalent to the thickness of the recording paper. In this way, the rotating force of the conveying roller 60 can reliably convey she recording paper. The spur roller 63 is similarly disposed with respect to she discharge roller 62. However, since the spur roller 63 presses against paper that has been printed, the roller surface of the spur roller 63 is shaped like a spur with alternating protruding and depressed parts so as not to degrade the image recorded on the paper.

Hence, paper interposed between the conveying roller 60 and pinch roller 61 is conveyed intermittently over the platen 42 at prescribed line feed amounts. The recording head 39 scans over the paper after each line feed to record an image beginning from the leading edge side of the recording paper. After an image has been recorded on the paper, the leading edge side becomes interposed between the discharge roller 62 and spur roller 63. At this time, the paper is conveyed intermittently at the prescribed line feed amount, while the leading edge side of the paper is interposed between the discharge roller 62 and spur roller 63 and the trailing edge side is interposed between the conveying roller 60 and pinch roller 61, during which time the recording head 39 continues recording an image on the paper. After the paper is conveyed farther and the trailing edge of the paper passes through and separates from the conveying roller 60 and pinch roller 61, the discharge roller 62 and spur roller 63 continue to convey the paper intermittently at the prescribed line feed amount, while the recording head 39 continues to record the image. After the image has been recorded in the prescribed recording region of the paper, the discharge roller 62 begins rotating continuously. Subsequently, the paper interposed between the discharge roller 62 and spur roller 63 is discharged onto the discharge tray 21.

Figure 9:
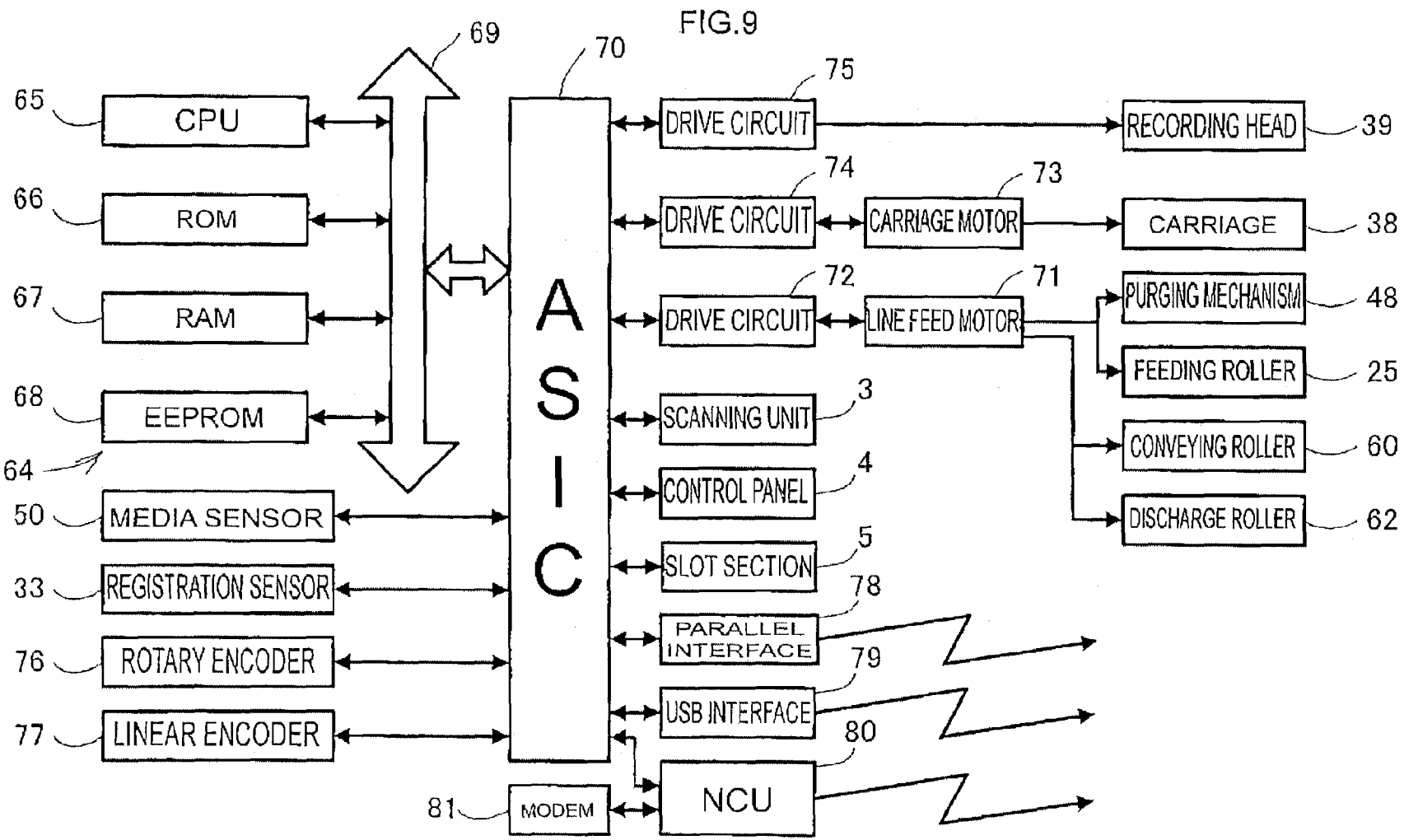
FIG. 9 is a block diagram showing the structure of a controller in the multifunction device.

FIG. 9 shows the structure of a controller 64 in the multifunction device 1. The controller 64 functions to control the overall operations of the multifunction device 1 including the printing unit 2 and scanning unit 3. However, a description of the detailed construction of the scanning unit 3 has been omitted. As shown in FIG. 9, the controller 64 is configured of a microcomputer that primarily includes a CPU 65, a ROM 66, a RAM 67, and EEPROM 68. The components of the microcomputer are connected to an application specific integrated circuit (ASIC) 70 via a bus 69.

The ROM 66 stores programs and the like for controlling various operations of the multifunction device 1. The RAM 67 functions as a storage area or work area for temporarily saving various data used by the CPU 65 in executing the programs.

On a command from the CPU 65, the ASIC 70 generates a phase excitation signal and the like for conducting electricity to the linefeed (conveying) motor 71 and for applying this signal to a drive circuit 72 of the linefeed motor 71. By supplying a drive signal to the linefeed motor 71 via the drive circuit 72, the ASIC 70 can control the rotation of the linefeed motor 71.

The drive circuit 72 drives the linefeed motor 71, which is connected to the feeding roller 25, conveying roller 60, discharge roller 62, and purging mechanism 48. Upon receiving an output signal from the ASIC 70, the drive circuit 72 generates an electric signal for rotating the linefeed motor 71. The electric signal rotates the linefeed motor 71, and the rotational force of the linefeed motor 71 is transferred to the feeding roller 25, conveying roller 60, discharge roller 62, and purging mechanism 48 via a drive mechanism well known in the art that includes gears, driving shafts, and the like.

Similarly, upon receiving a command from the CPU 65, the ASIC 70 generates a phase excitation signal and the like for supplying electricity to the carriage motor 73 and applies this signal to a drive circuit 74 of the carriage motor 73. By supplying a drive signal to the carriage motor 73 via the drive circuit 74, the ASIC 70 can control the rotation of the carriage motor 73.

The drive circuit 74 drives the carriage motor 73, which is connected to the carriage 38. Upon receiving an output signal from the ASIC 70, the drive circuit 74 generates an electric signal for rotating the carriage motor 73. The electric signal rotates the carriage motor 73, and the rotational force of the carriage motor 73 is transferred to the carriage 38 via the platen 44, thereby scanning the carriage 38 in a reciprocating motion.

The ASIC 70 also generates and outputs a signal to a drive circuit 75 based on a drive control procedure received from the CPU 65. According to the output signal received from the ASIC 70, the drive circuit 75 drives the recording head 39 to selectively elect ink onto recording paper at a prescribed timing.

The ASIC 70 is also connected to the registration sensor 33 that detects the recording paper on the conveying path 23, the rotary encoder 76 for detecting the rotated amount of the conveying roller 60, the linear encoder 77 for detecting the movement amount of the carriage 38, and the media sensor 50 for detecting the presence of the recording paper. A detection signal outputted from the media sensor 50 is stored in the RAM 67 via the ASIC 70 and the bus 69. The CPU 65 determines ends of the recording paper by analyzing the detection signal stored in the RAM 67 based on a program stored in the ROM 66.

The ASIC 70 is also connected to the scanning unit 3; the control panel 4 for specifying operations of the multifunction device 1; the slot section 5 in which various small memory cards can be inserted; a parallel interface 78, USB interface 79, and the like for exchanging data with a personal computer or other external device via a parallel cable or USB cable; and a network control unit (NCU) 80 and a modem 81 for implementing a facsimile function.

As shown in FIG. 5, the controller 64 is configured by a main circuit board 82. Recording signals and the like are transferred from the main circuit board 82 to the recording head 39 via a flat cable 83. The flat cable 83 is an insulated thin ribbon cable configured of conductors for transmitting electric signals, which conductors are coated in a synthetic resin film such as polyester film or the like. The flat cable 83 electrically connects the main circuit board 82 to a control circuit board (not shown) of the recording head 39. From the carriage 38, the flat cable 83 extends along the reciprocating direction of the carriage 38 and loops back to form a substantial U-shape with vertically overlapping sections. The U-shaped portion of the flat cable 83 is fixed to no member and changes shape while following the reciprocating motion of the carriage 38.

Figure 10:
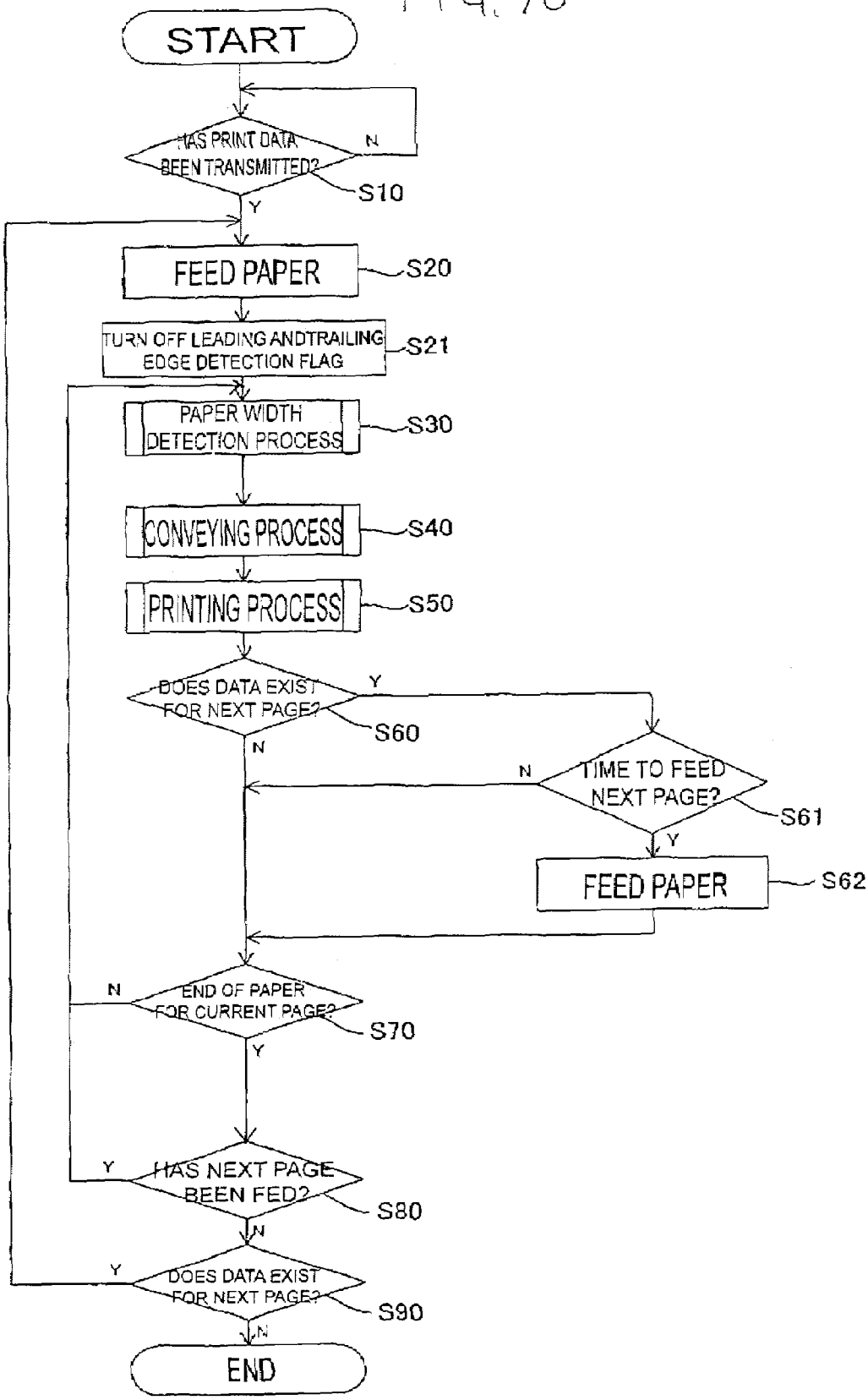
FIG. 10 is a flowchart illustrating steps in a printing operation performed by the multifunction device.
Figure 11:
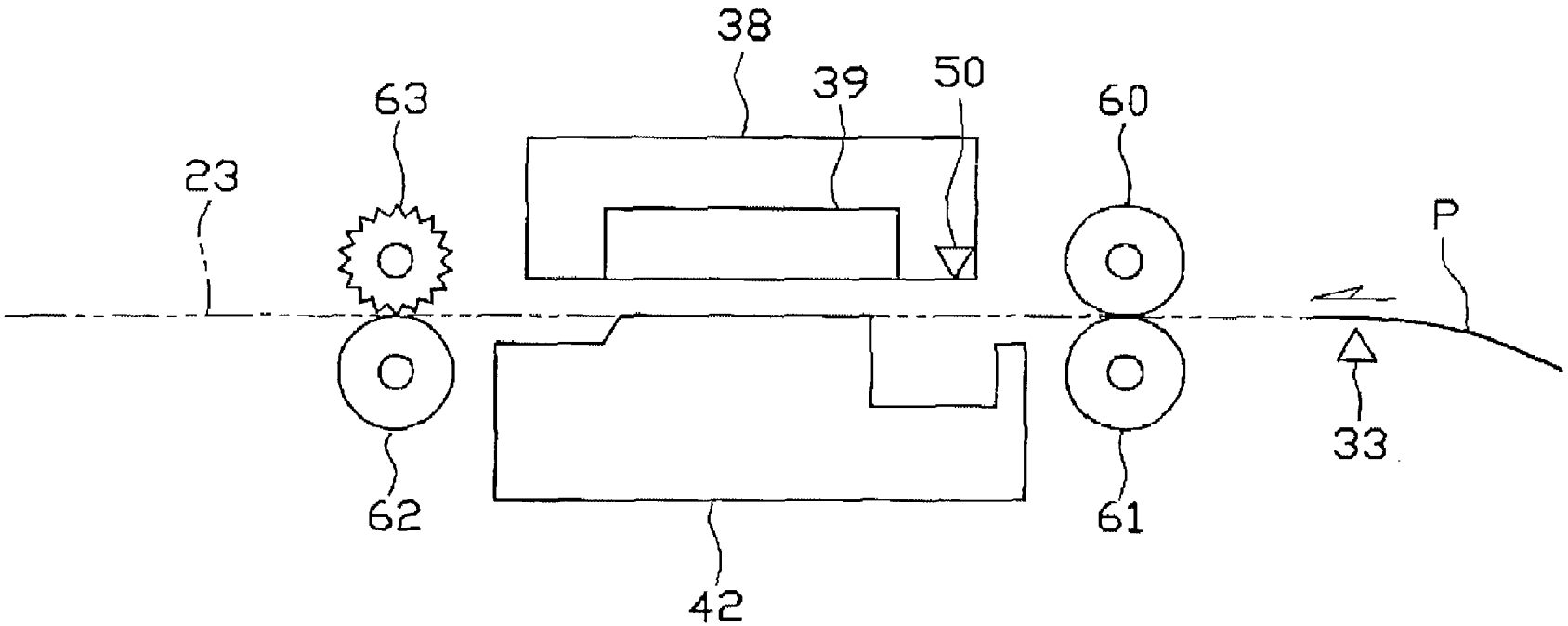
FIG. 11 is an explanatory diagram showing the conveying state of a recording paper P.

Next, an image-recording operation performed with the printing unit 2 will be described. FIG. 10 is a flowchart showing the steps in this operation. In S10 of FIG. 10, the controller 64 waits for print data to be transmitted from a personal computer or a small memory card. When print data has been received (S10: YES), in S20 the controller 64 begins feeding the recording paper 2 accommodated in the paper tray 20. Specifically, the ASIC 70 drives the linefeed rotor 71, and the driving force of the linefeed motor 71 is transferred to the feeding roller 25, conveying roller 60, and discharge roller 62 for conveying the recording paper P from the paper tray 20 onto the conveying path 23. The recording paper P is inverted while passing through the U-shaped portion of the conveying path 23, after which the registration sensor 33 detects the leading edge of the recording paper P, as illustrated in FIG. 11. After the registration sensor 33 detects the recording paper P, the controller 64 determines the inputted rotated amount of the conveying roller 60 and the like based on the encoder amount of the rotary encoder 76 and conveys the recording paper B so that the leading edge region of the recording paper P is directly below the media sensor 50.

In S21 the controller 64 turns both the trailing edge detection flag and leading edge detection flag off. These flags are stored in the EEPROM 68.

Figure 12:
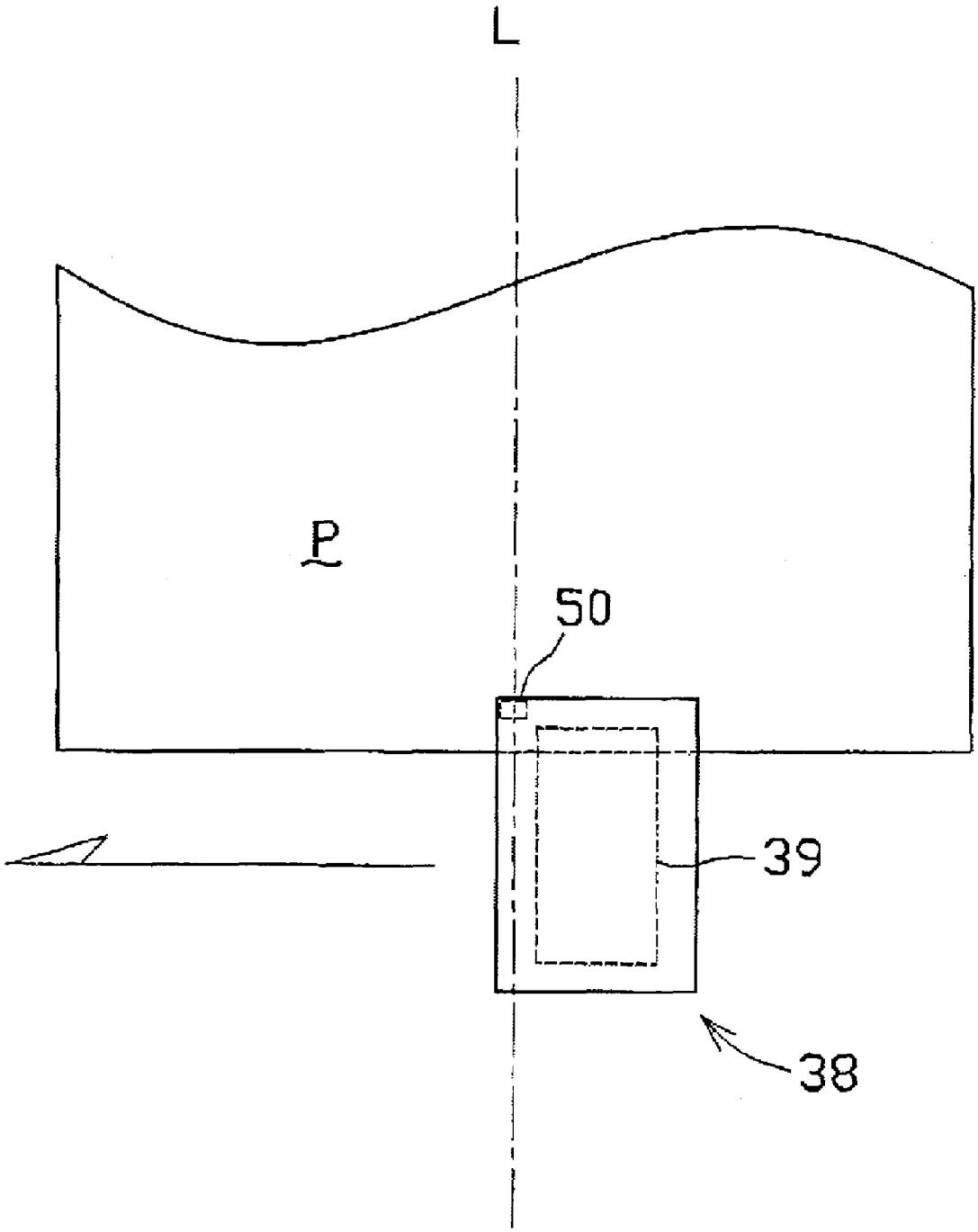
FIG. 12 is a plan view showing the position of the media sensor when adjusting the light intensity.
Figure 13:
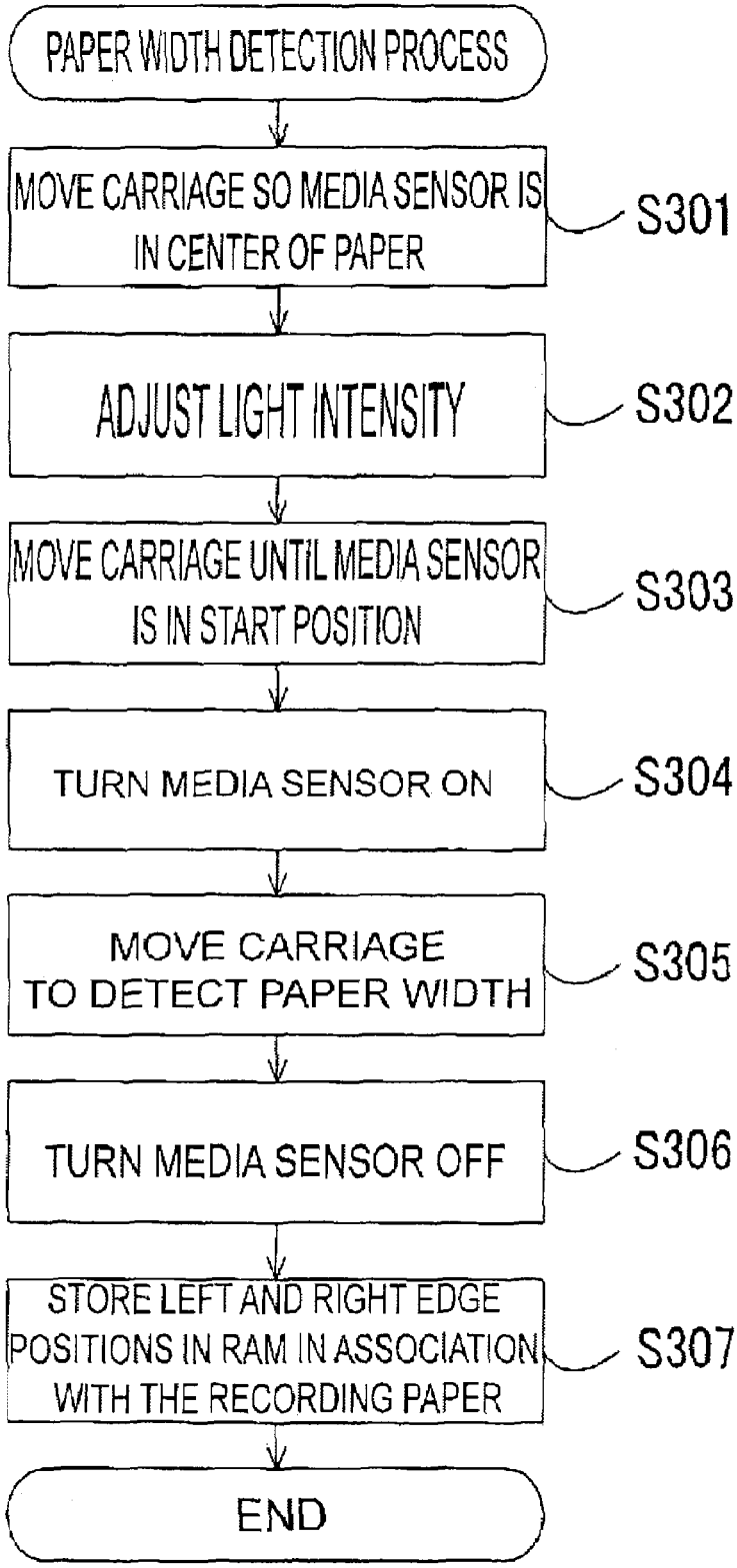
FIG. 13 is a flowchart illustrating steps in a paper width detection process.

In S30 the controller 64 detects the paper width in the leading edge region of the recording paper P. FIG. 13 is a flowchart showing steps in the paper width detection process. In S301 of FIG. 13, the controller 64 moves the carriage 38 so that the media sensor 50 is in a center position of the paper, as shown in FIG. 12. As shown in FIG. 12, the center of the conveying path 23 is indicated by a reference line L. The recording paper P is conveyed through the conveying path 23 so that the center position of the recording paper P, regardless of size, is aligned with the reference line L. Hence, the controller 64 moves the carriage 38 so that the media sensor 50 is positioned on the reference line L.

In S302 the controller 64 adjusts the light intensity of the media sensor 5O at this center position. Here, a prescribed electrical current is supplied to the light-emitting element 51 of the media sensor 50 so that the light-emitting element 51 emits light at a prescribed intensity. The light intensity of the light-emitting element 51 can be adjusted to suit different types of recording paper. For example, if the surfaces of the paper have been treated, as in gloss photo paper, the intensity of light received by the light-receiving element 52 will be greater since the gloss paper has a higher reflectance than normal paper. Similarly, the intensity of received light varies according to different colors of recording paper. Therefore, the intensity of light emitted from the light-emitting element 51 is adjusted so that the intensity of light received by the light-receiving element 52 when the recording paper is present remains uniform.

The procedure for adjusting light intensity is conducted as follows. The media sensor 50 in the center position shown in FIG. 12 is turned on, at which time the light-emitting element 51 emits light at an initial intensity, and the light-receiving element 52 receives the reflected light. The initial intensity is set low so that the intensity of light reflected off of all paper types does not achieve the target value. Therefore, the intensity of light received by the light-receiving element 52 at this time is less than the target value. Subsequently, the intensity of light emitted from the light-emitting element 51 is increased by prescribed increments until the intensity of light received by the light-receiving element 52 reaches the target value.

In S303 She controller 64 moves the carriage 38 from the center position shown in FIG. 12 to a start position for detecting the left and right edges of the recording paper P located outside the width range of the recording paper P. While the carriage 38 may be moved to either the lest or right side in the scanning direction, in this description the carriage 38 is moved to the left side in FIG. 12. One method of determining whether the carriage 38 is outside the width range of the recording paper P is to extract the size of the recording paper from recording paper information included in print data received from the computer (not shown). Alternatively, the carriage 38 may be moved to an end of its range of motion in the scanning direction, at which position the carriage 38 is outside the range of a recording paper having the maximum width that can be used in the multi-function device 1.

In S304 the controller 64 turns on the media sensor 50. In S305 the controller 64 moves the carriage 38 toward the opposite side of the start position in the width direction of the paper, that is, the right side in FIG. 12 in this example. During this time, the light-emitting element 51 of the media sensor 50 irradiates light at the adjusted light intensity, and the light-receiving element 52 receives this reflected light. An AD value outputted from the light-receiving element 52 is stored in the RAM 67 of the controller 64 in association with encoder amounts of the linear encoder 77, serving as positional data for the carriage 38. In S306 the controller 64 turns off the media sensor 50 after the carriage 38 has been moved across the entire width of the recording paper P to the opposite side from the start position.

Figure 14:
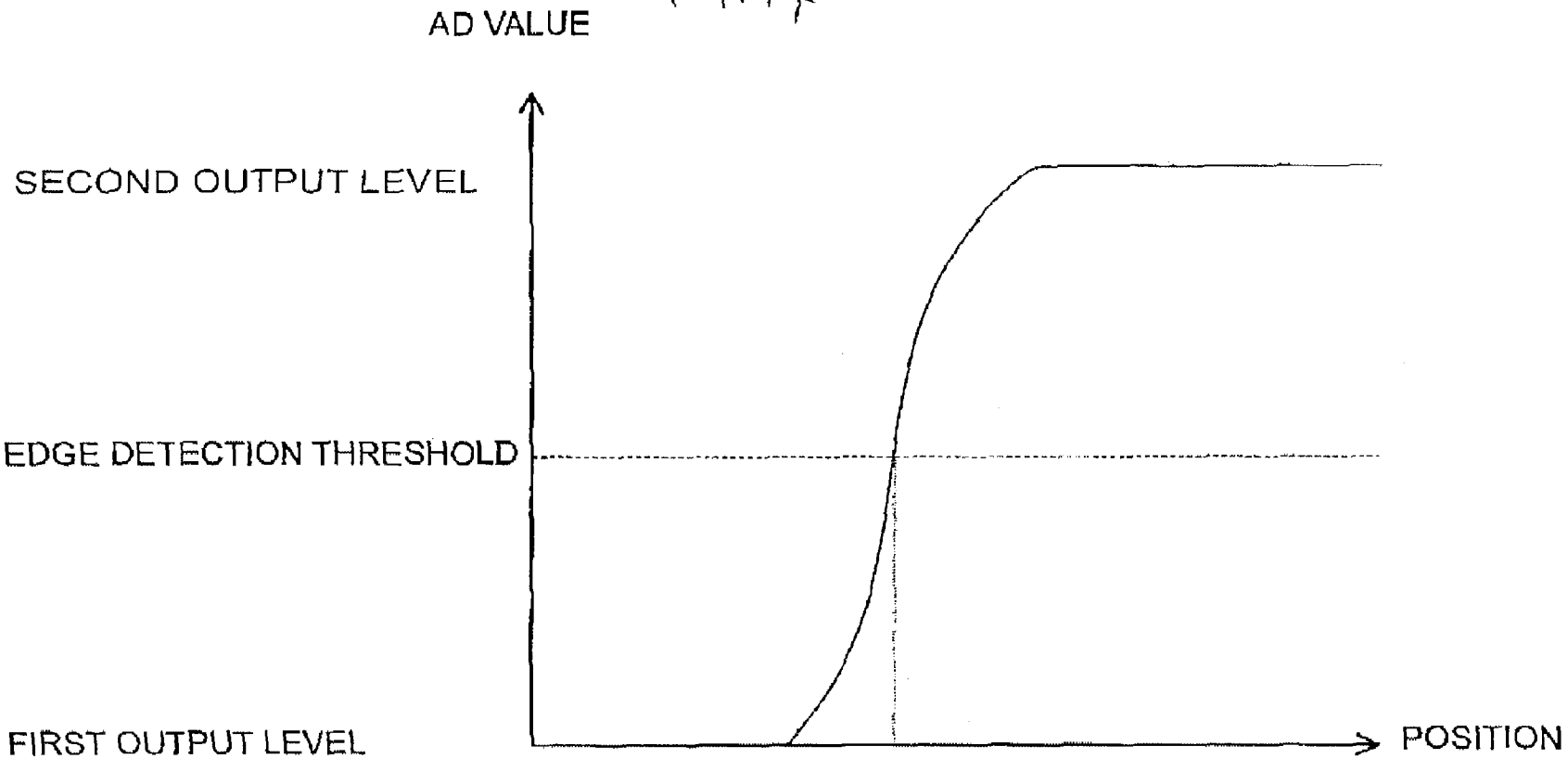
FIG. 14 is a graph showing the relationship of an AD value obtained by the media sensor and a paper edge position.

Hence, the left and right edges of the recording paper P can be detected based on the AD values stored in the RAM 67. FIG. 14 shows a graph indicating sample AD values stored in the RAM 67 for positions near the left edge of the recording paper 2 in FIG. 12. When the recording paper P is not present at a position opposing the media sensor 50, that is, when the light-receiving element 52 receives light reflected off the platen 42, the light-receiving element 52 outputs AD values of a low first output level. Near the left edge of the recording paper P, the AD values rise. When the media sensor 50 is within the widthwise range of the recording paper P, the light-receiving element 52 receives light reflected from the recording paper P, and the AD value outputted from the light-receiving element 52 is a high second output level. The detected AD value is determined to be the edge position of the paper at a detection threshold between the first output level and the second output level. This detection threshold is an intermediate value between the first output level and the second output level, for example. Near the right edge of the recording paper P, the AD values outputted from the light-receiving element 52 drop from the second output level to the first output level, and the edge position of the paper is determined to be at the detection threshold between these levels. By detecting the left and right edges of the recording paper P near the leading edge of the recording paper P, it is possible to accurately determine the width of the recording paper P prior to image recording. In S307, data for the left and right edge positions detected for the recording paper P, for example, are stored in the RAM 57 as edge data.

More specifically, the detected left and right edge positions for the recording paper P are stored in the RAM 67 as edge data. At this time, the controller 64 determines whether the detected left and right edge positions correspond to the recording paper P currently undergoing image recording or the next sheet of recording paper Pn. The controller 64 makes this determination based on the on/off state of the trailing edge detection flag and the leading edge detection flag stored in the EEPROM 68. Specifically, if both the trailing edge detection flag and the leading edge detection flag are off, then the media sensor 50 is positioned over the recording paper P currently undergoing image recording. Hence, the controller 64 determines that the detected left and right edge positions corresponding to the recording paper P. If the trailing edge detection flag is on and the leading edge detection flag is off, then the media sensor 50 is positioned between the recording paper P and the next sheet of recording paper Pn. Accordingly, the controller 64 does not detect left and right edges. If both the trailing edge detection flag and the leading edge detection flag are on, then the media sensor 50 is positioned over the next sheet of recording paper Pn. Hence, the controller 64 determines that the detected left and right edge positions correspond to the next sheet of recording paper Pn. Since the trailing edge detection flag and leading edge detection flag have been set to off in S21, The controller 64 stores the detected left and right positions in the RAM 67 as edge data for the recording paper P currently undergoing image recording. On the other hand, when the trailing edge detection flag and Leading edge detection flag is set to on, the controller 64 stores the detected left and right positions in the RAM 57 as edge data for the recording paper Pn to undergo image recording. In other words, the RAM 67 stores the left and right edges data, distinguishing between a left and right edge position of the recording paper P and a left and right edge position of the recording paper Pn. As described above, the controller 64 stores a left and right edge positions in the RAM 67 in association with a recording paper.

Figure 15:
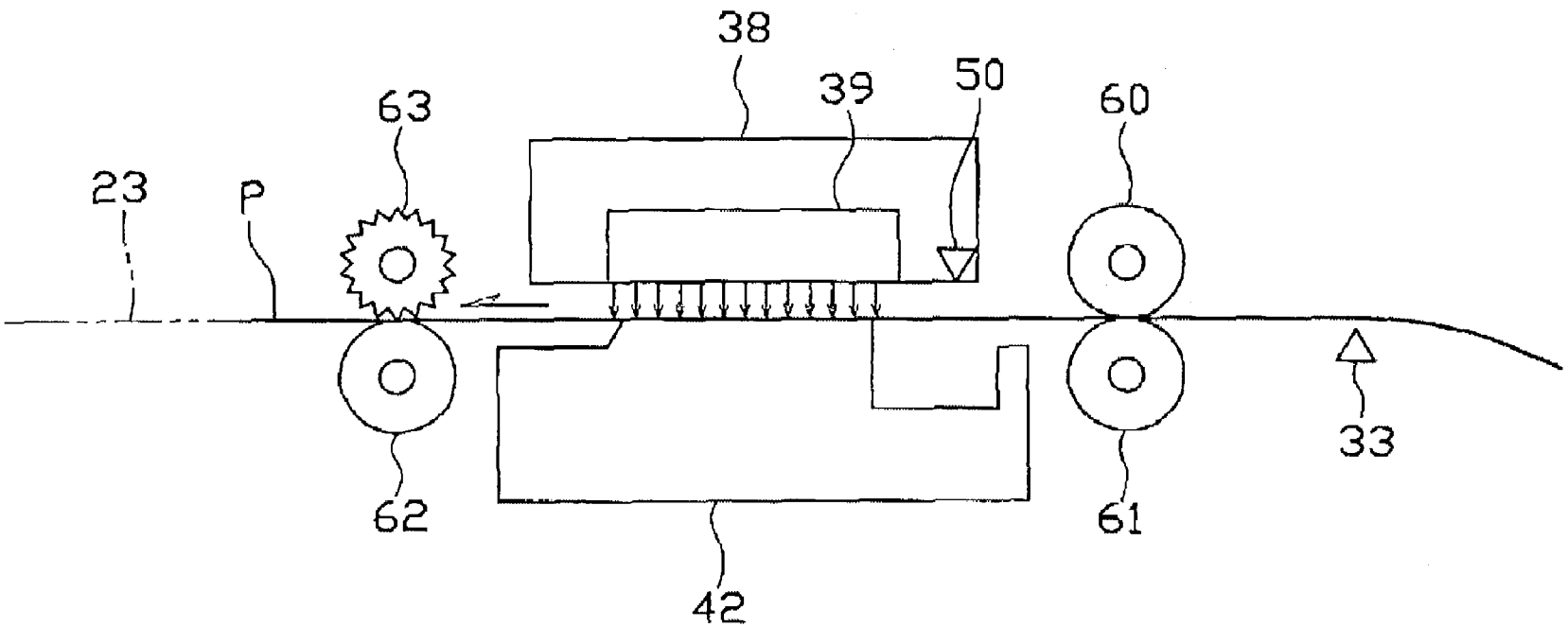
FIG. 15 is an explanatory diagram showing the conveying state of the recording paper P.
Figure 16:
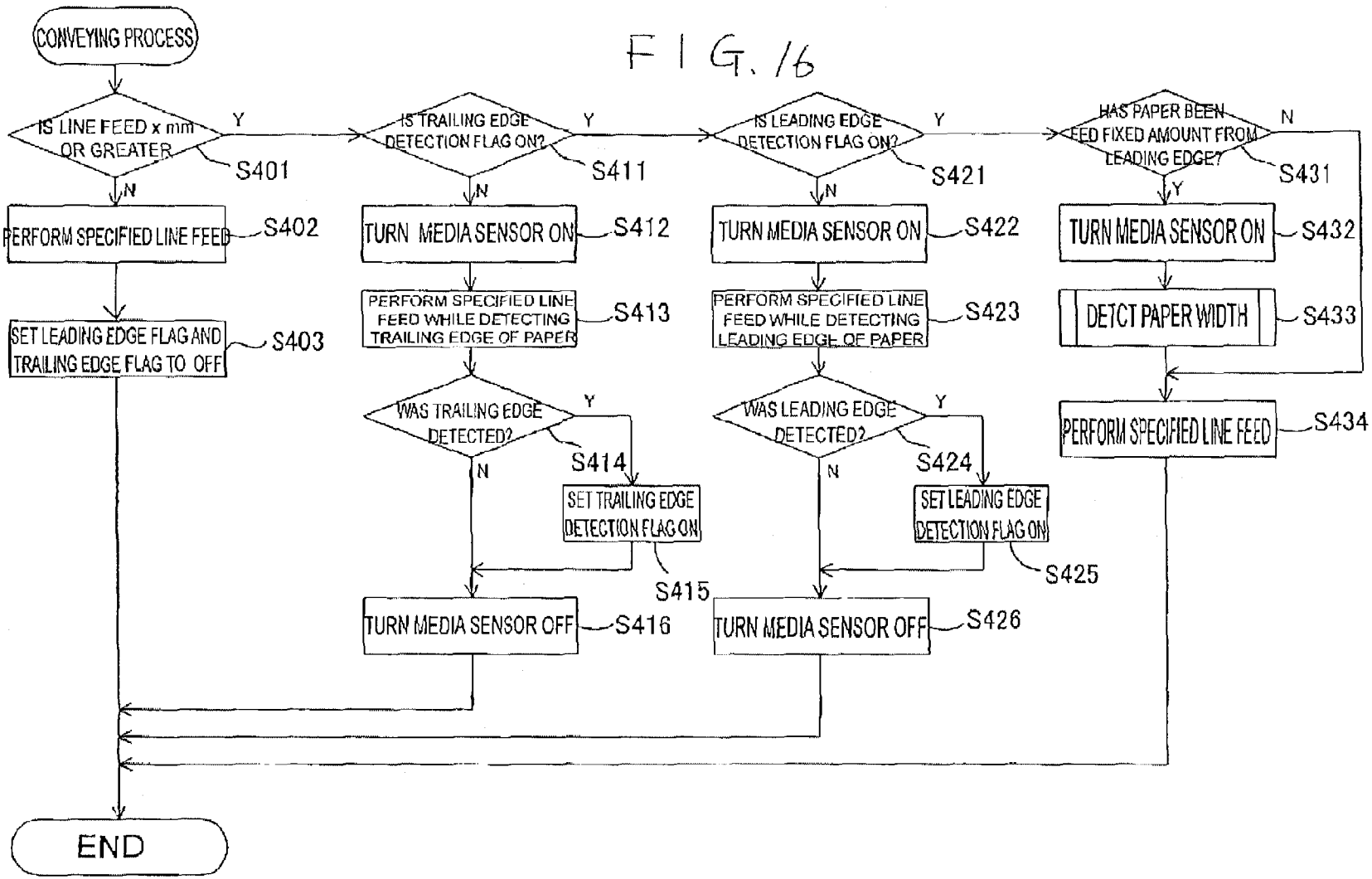
FIG. 16 is a flowchart illustrating steps in a conveying process.

In S40 of FIG. 10, the controller 64 conveys the recording paper P a prescribed conveying amount (line feed). In S50 image recording is performed beginning from the leading edge of the recording paper P, as shown in FIG. 15, by conveying the recording paper P interposed between the conveying roller 60 and pinch roller 61 prescribed line feed amounts while scanning the recording head 39 mounted in the carriage 38, one scan for each line feed. FIG. 16 is a flowchart showing a more detailed description of the conveying process.

In S401 of FIG. 16 the controller 64 determines whether the recording paper P has been conveyed x mm or more since the registration sensor 33 detected that the recording paper F was no longer present. This x is set for determining whether the trailing edge region of the recording paper F has arrived directly beneath the media sensor 50. For example, x may be set based on the distance that the recording paper P is conveyed after the registration sensor 33 detects the recording paper P no longer exists, that is, an encoder amount of the rotary encoder 76 indicating the rotational amount inputted from the conveying roller 60 and the like, and the distance along the conveying path from the registration sensor 33 to the media sensor 50. Accordingly, since the registration sensor 33 detects the existence of the recording paper P in the state shown in FIG. 15, in S402 the recording paper P is conveyed an amount corresponding to the prescribed line feed. In S403 the controller 69 saves a leading edge detection flag and a trailing edge detection flag in the EEPROM 68 as an off value.

Figure 17:
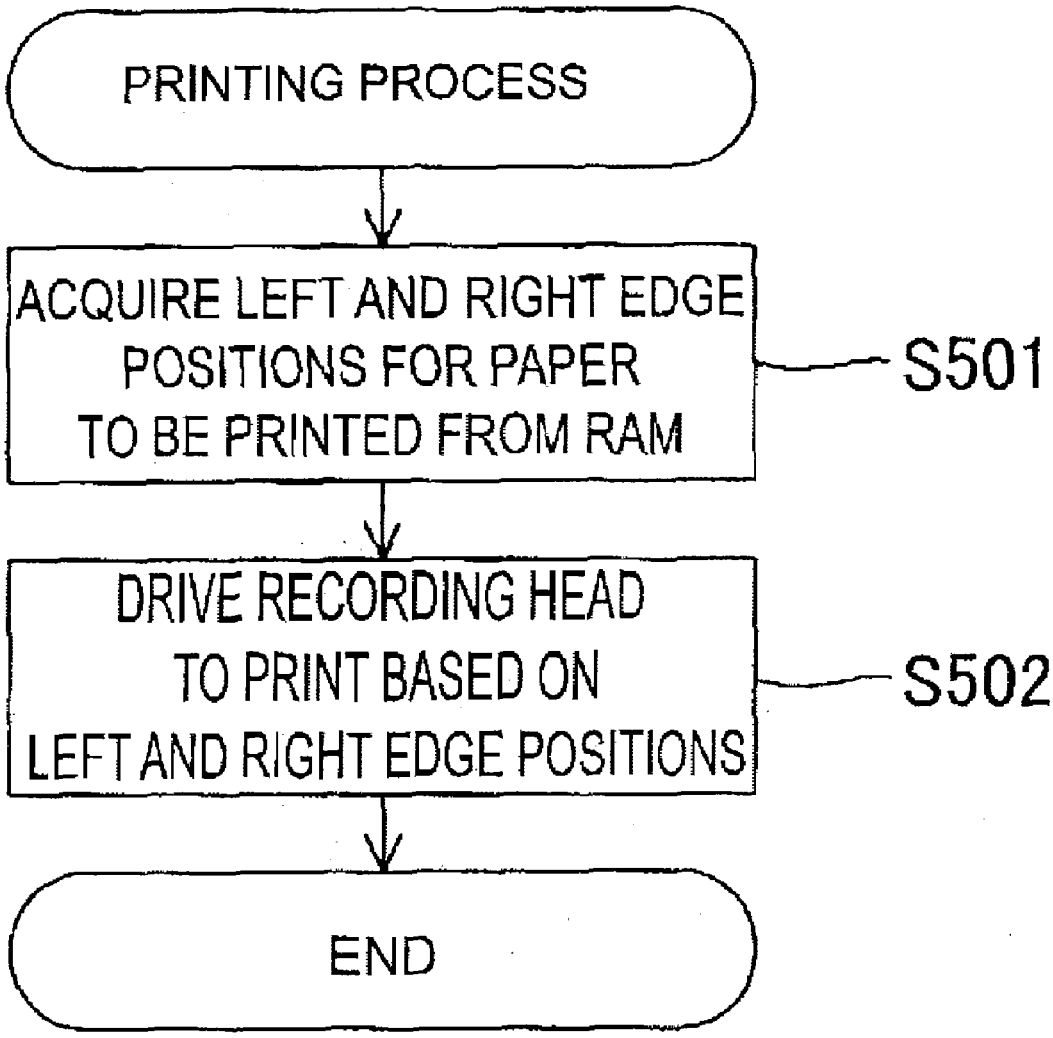
FIG. 17 is a flowchart illustrating steps in a printing process.

After the recording paper P is conveyed the prescribed line feed amount, the carriage 38 is scanned while the recording head 39 records an image. Specifically, in S501 of FIG. 17, the controller 64 reads edge data for the recording paper P stored in the RAM 67. In S502 the controller 64 matches the print data to the position of the recording paper P based on the left and right edge positions included in the position data and controls the recording head 39 to elect ink at a prescribed timing.

Generally, when recording images on a recording paper P, a computer (not shown) or the like transmits print data including data for the recording paper to the multifunction device 1. This data for the recording paper indicates the size of the recording paper P. Therefore, the controller 64 can control the operations of the carriage 38 and recording head 39 based or the recording paper data. However, the recording paper P is not always accurately conveyed in the same widthwise position on the platen 42. In reality, the widthwise position of the recording paper P on the platen 42 varies slightly each time the recording paper P is conveyed. When performing borderless printing in which an image is recorded all the way to the left and right edges of the recording paper P, it is preferable to accurately determine the left and right edges of the recording paper P and to control operations of the carriage 38 and recording head. 39 based on these positions in order to avoid white regions on the left or right edge of the recording paper P on which image recording was not performed and to minimize the amount of ink that the recording head 39 ejects outside of the recording paper P. Accordingly, it is possible to record images precisely to the left and right edges of the recording paper P.

After the recording head 39 has recorded an image for one line feed amount, in S60 of FIG. 10, the controller 64 determines whether the commuter (not shown) or the like has transmitted the next page of print data. If there is only one page worth of print data, then the controller 64 repeats the process in S30-S50 until the entire page worth of print data has been recorded. After the page worth of print data has been recorded (S70: YES), then the controller 64 ends the image-recording operation without feeding a subsequent sheet of paper (S80, S90). More specifically, if the page worth of print data has not been recorded (S70: NO), then the controller 64 repeats the process in S30-S50. If the next page, that is, the recording paper Pn, has been fed (S80: YES), then the controller 64 detects the paper width in the leading edge region (S30). The controller 64 repeats the process in S30-S70. If the next page, that is, the recording paper Pn has not been fed, the controller 64 determines whether data exists for next page (S90). If the data exists (S90: YES), the controller 64 begins feeding the next page, that is the recording paper Pn (S20). The controller 64 repeats the process in S20-S80. On the other hand, if the data does not exist (S90: END), the image-recording operation as ended. While the paper width detection in S30 is preferably performed for each prescribed line feed, paper width detection may be performed at prescribed conveying amounts greater than the line feed amount or only at the leading edge region of the recording paper P. However, when it is necessary to accurately record images to the left and right edges of the recording paper F in borderless printing, it is preferable to perform paper width detection a plurality of times for each sheet of recording paper at prescribed conveying amounts.

If the image data to be recorded includes a plurality of pages worth, and the controller 64 determines in S60 that the computer or the like has transmitted the nexus pace worth of data (S60: YES), then in S61 the controller 64 determines whether it is time to feed the next sheet of pacer. Since the multifunction device 1 is preferably capable of printing the recording paper P continuously, a next sheet of recording paper Pn to be printed is conveyed from the paper tray 20 to the conveying path. 23 in S62 at a prescribed timing before the recording paper P currently undergoing image recording has been discharged entirely onto the discharge tray 21.

This continuous feeding is achieved by immediately conveying the next sheet of recording paper Pn after the registration sensor 33 detects that the recording paper 2 currently undergoing image recording is no longer present. Since the recording paper P currently undergoing image recording is conveyed intermittently at prescribed line feed amounts by the conveying roller 60 and discharge roller 62 while image recording is performed for each line feed, the feeding roller 25 conveys the next sheet of recording paper Pn continuously. Accordingly, the next sheet of recording paper Pn is conveyed faster than the recording paper P. After the registration sensor 33 detects the existence of the next sheet of recording paper Pn, the next sheet of recording paper Pn is then conveyed intermittently in synchronization with the recording paper P. Hence, the current recording paper P and the next sheet of recording paper Pn are conveyed through the conveying path 23 while separated a prescribed distance in the conveying direction. In this way, it is possible to reduce the time required to convey each sheet of the recording paper P when recording images on a plurality of sheets, thereby reducing the time required for the image-recording operation.

Next, an operation will be described for detecting the trailing edge of the recording paper P currently undergoing image recording and the leading edge of the next sheet of recording paper Pn to undergo image recording during continuous feeding.

Figure 18:
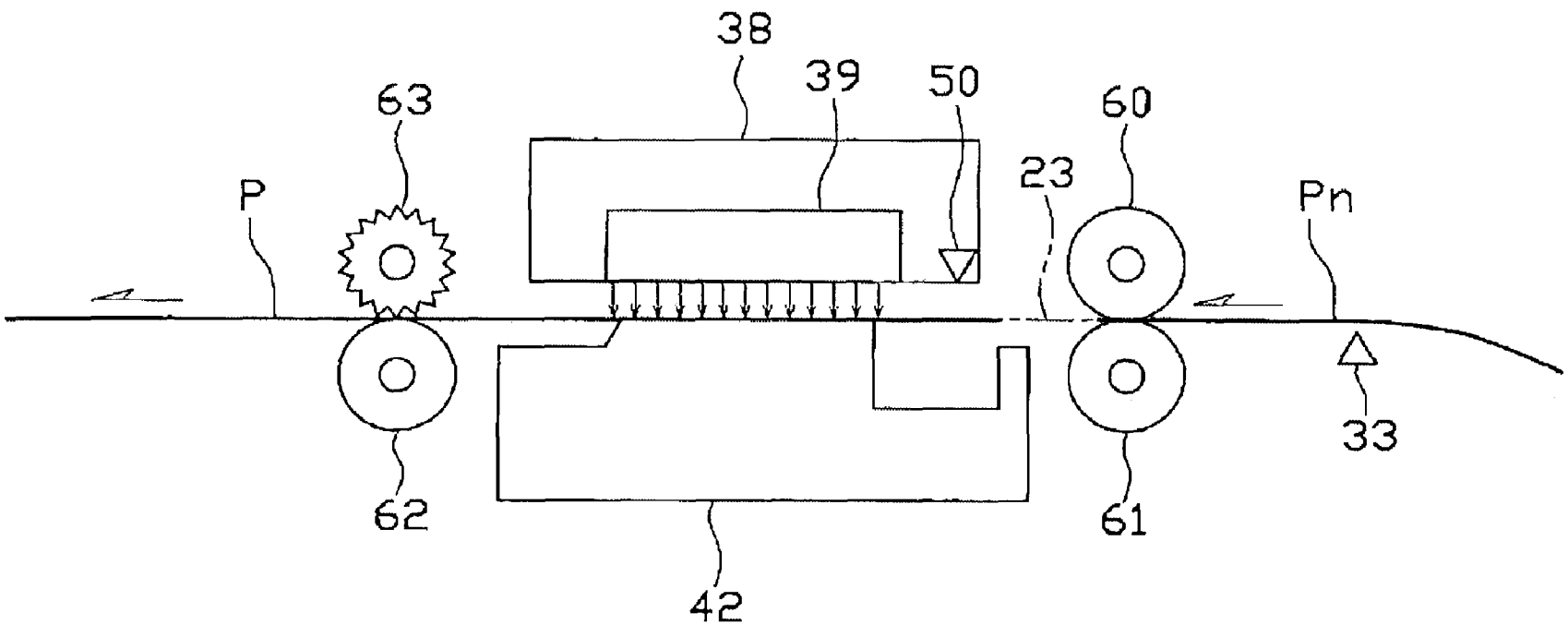
FIG. 18 is an explanatory diagram showing the conveying state of a recording paper P and a next recording paper Pn.

As shown in FIG. 18, in continuous feeding the recording paper P currently undergoing image recording and the next sheet of recording paper Pn are conveyed simultaneously along the conveying path 23 while separated from each other in the conveying direction. When performing borderless printing, for example, it is necessary to detect with accuracy the trailing edge position of the recording paper P in order to align the image accurately on the recording paper P. Similarly, it is necessary to detect the leading edge position of the next sheet of recording paper Pn with accuracy. Further, if a paper jam occurs after the registration sensor 33 detects the presence of the next sheet of recording paper Pn, the controller 64 must determine whether the paper jam occurred with the recording paper P or whether the paper jam occurred with the next sheet of recording paper Pn after completing image recording on the recording paper P to determine which sheet must be reprinted after the paper jam is resolved further, since the media sensor 50 and the recording head 39 are in different positions on the carriage 38 with respect to the conveying direction, as shown in the drawings, it is necessary to determine whether the recording paper detected by the media sensor 50 is the recording paper P or the next sheet of recording paper Pn. Accordingly, it is necessary to detect the distance between the recording paper P and the next sheet of recording paper Pn with accuracy when performing borderless printing and continuous feeding.

The media sensor 50 can detect the next sheet of recording paper Pn while the recording head 39 is still recording an image on the recording paper P. In order to perform borderless printing with accuracy from the leading edge of the next sheet of recording paper Pn, the media sensor 50 detects the left and right edges of the next sheet of recording paper Pn when detection is possible (when the recording paper Pn arrives at a position that can be detected by the media sensor 50).

Figure 19:
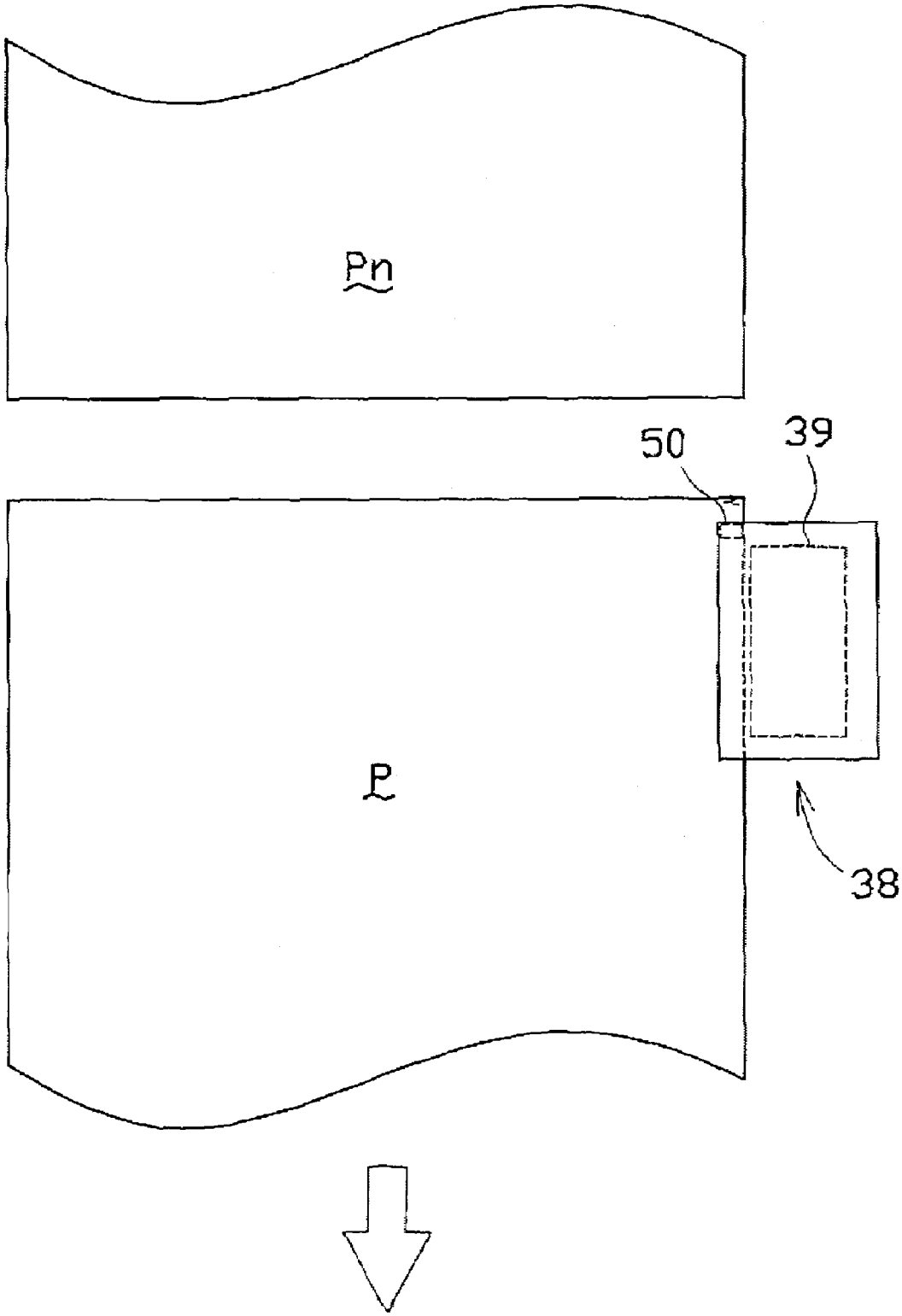
FIG. 19 is a plan view showing the standby position of the carriage during a trailing edge detection.

In S401 of FIG. 16, the controller 64 determines whether the recording paper P has been conveyed x mm or greater since the registration sensor 33 no longer detected the presence of the recording paper P. If the trailing edge region of the recording paper P arrives directly below the media sensor 50, as illustrated in FIG. 19, the carriage 38 is placed in a standby position, that is, the controller 64 controls carriage 38 to be placed in a standby position, after an image has been recorded for the current scan line. And the recording paper P is conveyed another line feed amount, in order that the media sensor 50 can detect the trailing edge of the recording paper P. Since the media sensor 50 has not detected the trailing edge of the recording paper P in the state shown in FIG. 19, in S411 the controller 64 determines that the trailing edge detection flag is off. In this way, a normal image-recording operation is performed without placing the carriage 38 in the standby position until the trailing edge region of the recording paper P currently undergoing image recording has arrived at the detection position of the media sensor 50. When the trailing edge region has arrived at this detection position, the carriage 38 is placed in the standby position so that the media sensor 50 can detect the trailing edge of the recording paper P and the leading edge of the next sheet of recording paper Pn. This method eliminates leading edge and trailing edge detection operations at positions not near the leading edge and trailing edge of the recording paper P, thereby increasing the operating speed in image recording.

More specifically, when the carriage 38 is placed in the standby position shown in FIG. 19, the recording head 39 is positioned off the recording paper P, that is, farther right than the right edge of the recording paper P in FIG. 19, while the media sensor 50 is positioned over the recording paper P, that is, leftward of the right edge of the recording paper P in FIG. 19. In S412 the controller 64 turns the media sensor 50 on while the carriage 38 is in the standby position. The standby position is set based on edge data for the recording paper P that has already been detected. More specifically, the standby position is such that the recording head 39 is outside an area through which the recording paper P passes and that the media sensor 50 is within the area through which the recording paper P passes. Accordingly, the recording head 39 can be reliably positioned off the recording paper P, while the media sensor 50 is reliably positioned over the recording paper P. As described above, the carriage 38 is placed in the standby position, after the recording head 39 records a prescribed line feed amount of an image.

In S413 the controller 64 drives the conveying roller 60 and the discharge roller 62 to convey the recording paper P and the next sheet of recording paper Pn a prescribed line feed amount while the carriage 38 is in the standby position Since the recording head 39 is positioned off the recording paper P, neither the recording paper P nor the next sheet of recording paper Pn can contact the recording head 39 when they are conveyed. In particular, the leading edge of the next sheet of recording paper Pn has a tendency to project upward after the next sheet of recording paper Pn has been inverted from the lower path to the upper path, but this configuration prevents the leading edge of the next sheet of recording paper Pn from contacting the recording head 39.

However, by positioning the media sensor 50 within the range of the recording paper P, it is possible to accurately detect the trailing edge of the recording paper P currently undergoing image recording as the recording paper P is conveyed the prescribed line feed amount. The controller 64 determines whether the media sensor 50 has detected this trailing edge in S414. The method of detecting the trailing edge of the recording paper P is similar to the method of detecting the left and right edges of the recording paper P. Specifically, the recording paper P is conveyed while the media sensor 50 is on. During this time, the light-emitting element 51 of the media sensor 50 irradiates light, while the light-receiving element 52 receives the reflected light. AD values for the reflected light are outputted from the light-receiving element 52 and stored in the RAM 67 of the controller 64 in association with encoder amounts from the rotary encoder 76 of the conveying roller 60. The controller 64 detects the trailing edge of the recording paper P from the paper edge detection threshold value based on the AD values stored in the RAM 67. When the trailing edge of the recording paper P is detected by the controller 64 (S414: YES), then in S415 the controller 64 turns or, and stores the trailing edge detection flag in the EEPROM 68 and in S416 turns off the media sensor 50. The trailing edge position of the recording paper P is stored in the RAM 67 as edge data. However, if the trailing edge of the recording paper P has not been detected, then in S416 the controller 64 turns the media sensor 50 off while the trailing edge detection flag remains off.

As described above, the controller 64 stores edge data (edge data for the recording paper P up to the trailing edge position) in the RAM 67 as edge data For the recording paper P currently undergoing image recording until the trailing edge detection flag stored in the EEPROM 68 is turned on.

When the trailing edge position of the recording paper P has been detected, the controller 64 controls ink ejection from the recording head 39 based on the edge data for the recording paper P stored in the RAN 67 so that print data for the current image recording process is recorded up to the detected trailing edge position of the recording paper P. In this way, borderless printing can be performed accurately to the trailing edge of the recording paper P.

Figure 20:
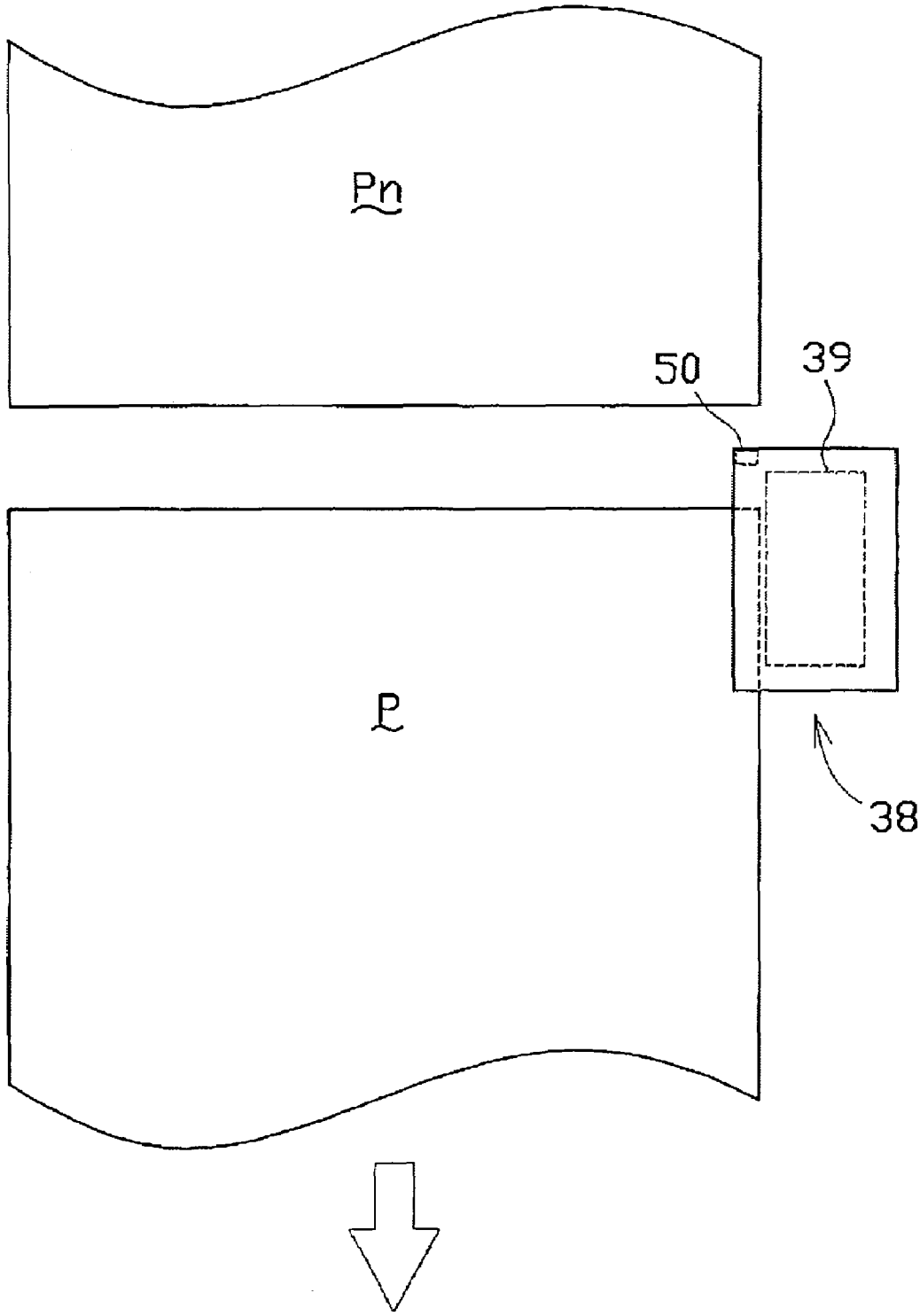
FIG. 20 is a plan view showing the standby position of the carriage during a leading edge detection.

After the trailing edge of the recording paper P has been detected, the carriage 38 is placed in the standby position so that the recording head 39 is outside the range of the recording paper P and the media sensor 50 is within the range of the recording paper P, as shown in FIG. 20, until the leading edge of the next sheet of recording paper Pn, has been detected. Since the leading edge of the next sheet of recording paper Pn has yet to be detected in the state shown in FIG. 20, in S421 the controller 64 determines that the leading edge detection flag is off (S421: NO). In S422 the controller 64 turns on the media sensor 50 while the carriage 38 is in the standby position.

In S423 the controller 64 drives the conveying roller 60 and the discharge roller 62 to convey the recording paper P and the next sheet of recording paper Pn a prescribed line feed amount while the carriage 38 is in the standby position.

As described above, since the recording head 39 is outside the range of the next sheet of recording paper Pn, the leading edge of the next sheet of recording paper Pn does not contact the recording head 39 when the recording paper P and next sheet of recording paper Pn are conveyed.

However, by positioning the media sensor 50 within the conveying path of the next sheet of recording paper Pn, it is possible to accurately detect in S424 the leading edge of the next sheet of recording paper Pn as the recording paper Pn is conveyed the prescribed line feed amounts. The method of detecting the leading edge of the recording paper is similar to the method of detecting the left and right edges of the recording paper. Specifically, the recording paper Pn is conveyed while the media sensor 50 is on. During this time, the light-emitting element 51 of the media sensor 50 irradiates light, while the light-receiving element 52 receives the reflected light. AD values for the reflected light are outputted from the light-receiving element 52 and stored in the RAM 67 of the controller 64 in association with encoder amounts from the rotary encoder 76 of the conveying roller 60. The controller 64 detects the leading edge of the recording paper Pn from the paper edge detection threshold value based on the AD values stored in the RAM 67. When the leading edge of the recording paper Pn is detected by the controller 64 (S424: YES), then in S425 the controller 64 turns on and stores the leading edge detection flag in the EEPROM 68. The leading edge position of the recording paper Pn is stored in the RAM 67 as edge data. In the above operations, the recording paper Pn is conveyed before the image recording has been completed on the recording paper P.

However, when the leading edge of the next sheet of recording paper Pn has not been detected yet (S424: NO), in S426 the controller 64 turns off the media sensor 50 while the leading edge detection flag remains off.

If the trailing edge detection flag is on and the leading edge detection flag is on, the controller 64 can determine that the gap between the recording paper P and next sheet of recording paper Pn has been detected. Therefore, the controller 64 can determine that the subsequent AD value outputted from the media sensor 50 is the next sheet of recording paper Pn. The controller 64 stores edge data after the controller 64 turns off and stores the leading edge detection flag in the EEROM 68, that is, edge data from the leading edge position of the next sheet of recording paper Pn, in the RAM 67 as edge data for the next sheet of recording paper Pn. After the leading edge detection flag is set to on in the EEPROM 68, a normal recording operation can be performed without moving the carriage 38 to the standby position. In other words, after conveying the recording paper P a prescribed line feed amount, the carriage 33 is scanned while the recording head 39 ejects ink droplets at a prescribed timing based on edge data for the recording paper P stored in the RAM 67. Then the recording paper P is conveyed another prescribed line feed while the carriage 38 is positioned outside the range of the recording paper P, but without putting the carriage 38 in the standby position. Thereafter, the carriage 38 is again scanned while the recording head 39 records an image.

In S431 the controller 64 determines whether the next sheet of recording paper Pn has been conveyed a fixed distance (fixed amount) from the leading edge if the leading edge is detected and the leading edge detection flag is turned on (S421: YES). If the next sheet of recording paper Pn has been conveyed a prescribed amount (S421: YES), then in S432 the controller 64 turns on the media sensor 50 and in S433 detects the width of the next sheet of recording paper Pn near the leading edge. The position at which this width detection is performed is set based on a prescribed conveying amount (for example, line feed amount) from the leading edge position, due to potential for skew in the next sheet of recording paper Pn.

However, if the next sheet of recording paper Pn has not been conveyed the prescribed amount from the leading edge position (S431: NO), then in S434 the controller 64 conveys the next sheet of recording paper Pn a specified amount. In S50 of FIG. 10 the controller 64 performs a printing operation on the recording paper P based on print data for the current recording operation by controlling ink ejection from the recording head 39 based on edge data for the recording paper P stored in the RAM 67.

Figure 21:
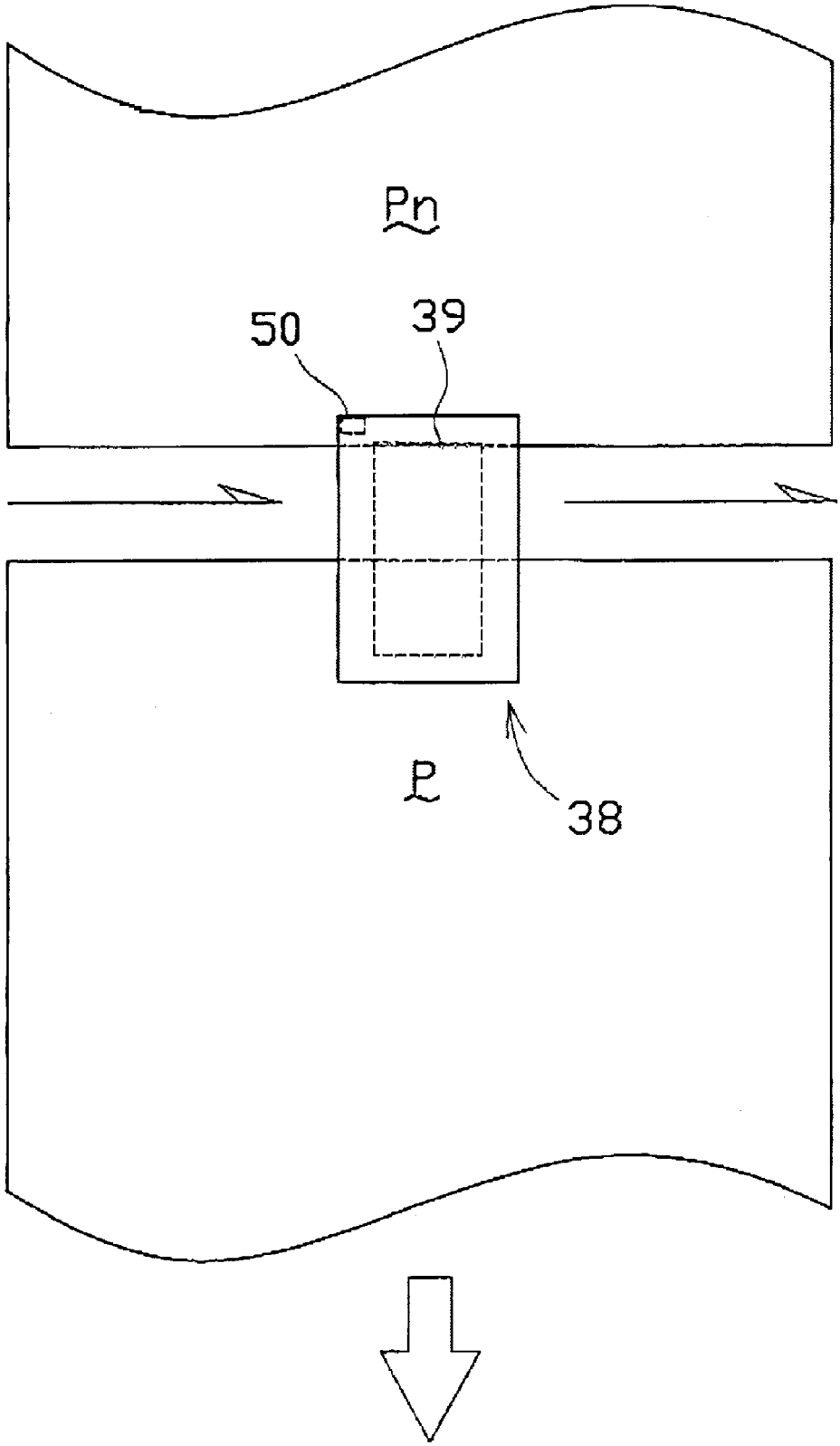
FIG. 21 a plan view showing the position of the carriage when detecting the width of the next recording paper Pn.

FIG. 21 shows the carriage 38 when the media sensor 50 is positioned over the next sheet of recording paper Pn a prescribed distance from the leading edge of the next sheet of recording paper Pn, that is, when the media sensor 50 is positioned for detecting the widthwise edges of the next sheet of recording paper Pn near the leading edge. In this state, the recording head 39 is positioned near the trailing edge of the recording paper P and is performing image recording on the recording paper P. After conveying the next sheet of recording paper Pn and positioning the media sensor 50 as shown in FIG. 21, the controller 64 interrupts image recording on the recording paper P in order to perform paper width detection on the next sheet of recording paper Pn. This paper width detection in S433 is identical to the process shown in FIG. 13. Specifically, after moving the carriage 38 so that the media sensor 50 is centrally positioned on the paper, as shown in FIG. 21, and adjusting the light intensity of the media sensor 50, the carriage 38 is moved to the start position (left side in FIG. 21) outside of the range of the recording paper P from the center position shown in the drawing in order to detect the left and right edges of the next sheet of recording paper Pn. Next, the carriage 38 is moved to the right, during which time AD values sequentially outputted from the media sensor 50 are stored in the RAM 67 in association with encoder amounts for the linear encoder 77. The left and right edges of the next sheet of recording paper Pn are detected based on these AD values.

The edge data obtained in this way is stored in the RAM 67 for the next sheet of recording paper Pn. As described above, the controller 64 detects the gap between the recording paper P and the next sheet of recording paper Pn and determines that subsequent AD values outputted from the media sensor 50 belong to the next sheet of recording paper Pn. In other words, the controller 64 determines whether the left and right edge positions based on AD values outputted from the media sensor 50 correspond to the next sheet of recording paper Pn based on whether the trailing edge detection flag and the leading edge detection flag are on. Hence, the controller 64 stores left and right edge positions (left and right edge data) of the next sheet of recording paper Pn in the RAM 67 so as to be differentiated (distinguishable) from the edge data for the recording paper P.

After detecting the left and right edges in the next sheet of recording paper Pn, in S50 the controller 64 continues to record an image in the trailing edge region of the recording paper P. At this time, ink ejection of the recording head 39 is controlled using the edge data for the recording paper P store: in the RAM 67. Hence, after detecting the left and right edges of the next sheet of recording paper Pn, it is still possible to perform borderless printing on the trailing edge of the recording paper P with accuracy based on the left and right edge position and the trailing edge position for the recording paper P. In other words, the recording head 39 records an image on the recording paper P within a range up to the trailing edge of the recording paper P detected by the controller 64. The recording head 39 can also record an image on the recording paper Pn within a range beginning from the leading edge of the recording paper Pn detected by the controller 64. After all print data has been recorded on the recording paper P, in S70 the image recording process for the recording paper P ends.

Since the next sheet of recording paper Pn has already been fed (S80: YES) and since the left and right edge positions of the next sheet of recording paper Pn near the leading edge thereof have been stored in the RAM 67 as edge data for the next sheet of recording paper Pn (S433), in S434 (S40) the next sheet of recording paper Pn is conveyed a prescribed conveying amount, and in S50 the controller 64 controls ink ejection of the recording head 39 based on the edge data corresponding to the next sheet of recording paper Pn. In other words, print data to be recorded on the next sheet of recording paper Pn is printed by controlling ink election from the recording head 39 based on edge data corresponding to the next sheet of recording paper Pn. Accordingly, borderless printing can be performed accurately based on leading edge and left and right edge positions corresponding to the next sheet of recording paper Pn.

The multifunction device 1 having the construction described above stores edge data based on AD values of the media sensor 50 in the RAM 67 in association with the recording paper P and the next sheet of recording paper Pn, and the recording head 39 records images based on the edge data corresponding to the recording paper P and next sheet of recording paper Pn. Accordingly, image recording can be accurately performed to the left and right edges of both the recording paper P and the next sheet of recording paper Pn.

During continuous feeding, the multifunction device 1 can convey a recording paper Pn to be recorded in prescribed line feed amounts, while accurately detecting the position of the leading edge of the recording paper Pn being conveyed. Accordingly, the multifunction device 1 can reliably detect the existence of a gap between sheets during continuous feeding.

In the multifunction device 1 having this construction, the controller 64 can controls the media sensor 50 mounted on the carriage 38 together with the recording head 39 to detect the trailing edge of a recording paper Pn on which the recording head 39 is recording an image, while the recording paper P is conveyed a prescribed Line feed amounts. Similarly, the controller 64 can control the media sensor 50 to detect the leading edge of the recording paper Pn to undergoing image recording.

By detecting the trailing edge of the recording paper P and the leading edge of the recording paper Pn, it is possible for the controller 64 to accurately detect the gap between sheets during continuous feeding. Therefore, when the multifunction device 1 is performing borderless printing on the recording papers, for example, the multifunction device 1 can accurately record images to the leading and trailing edges of the recording paper.

Further, the controller controls the carriage 38 to wait in the standby position, at which position the recording head 39 is outside the path of the recording paper P, the media sensor can detect the leading edge of the recording paper Pn and trailing edge of the recording paper P while the recording papers P and Pn is prevented from contacting the recording head 39.

The controller 64 determines which recording paper is associated with the left and right edge data detected by the controller 64 based on whether the media sensor 50 is positioned over the next recording paper Pn to undergo image recording. In this way, the left and right edge data stored in the RAM 67 can be accurately associated with the recording paper P currently undergoing image recording and the recording paper Pn to undergoing image recording.

In the above-described multifunction device 1, the leading edge of a subsequent recording paper Pn is prevented from contacting the recording head by placing the recording head 39 outside the path of the recording paper, in the standby position, thereby preventing the recording papers P, Pn from getting dirty. Further, by placing the media sensor 50 within the path of the recording papers P and Pn in the standby position, the media sensor 50 can detect the leading of the recording paper Pn and the trailing edges of the recording paper P as the recording paper P is conveyed by prescribed line feed amounts, thereby reliably associating the left and right edge data stored in the RAM 67 with the recording paper P or with the recording paper Pn. Since the recording head 39 performs image recording based on the left and right edge data associated with the recording paper undergoing image recording, the multifunction device 1 can accurately record images to the left and right edges of the recording papers P and Pn when performing borderless printing on the recording papers, for example.

Further, the multifunction device 1 can convey the recording paper Pn to be recorded to the detection position of the registration sensor 33 while recording an image on the recording paper P in a continuous feeding process, in order to decrease the time required for feeding the recording paper Pn and, hence, to increase the image recording speed. Further, it is possible to detect the leading edge of the recording paper Pn accurately during continuous feeding, enabling accurate borderless printing to the leading and trailing edges of the recording papers.

While the invention has been described in detail with reference to the above aspects thereof, it would be apparent to those skilled in the art that various changes and modifications may be made therein without departing from the spirit of the invention.

In the above aspects, the reference line L is set to the center of the conveying path 23, as shown in FIG. 12, and the recording paper P is conveyed so that the center is aligned with the reference line L. However, in the modification shown in FIG. 22, the reference line L' is set to a widthwise edge of the conveying path 23, and the recording paper P is conveyed so that a widthwise edge of the recording paper 2 is aligned with the reference line L'. In other words, one edge of the recording paper P in the scanning direction, that is, either the left or right edge of the recording paper P, moves along the reference line L' in parallel with the conveying direction.

Figure 22:
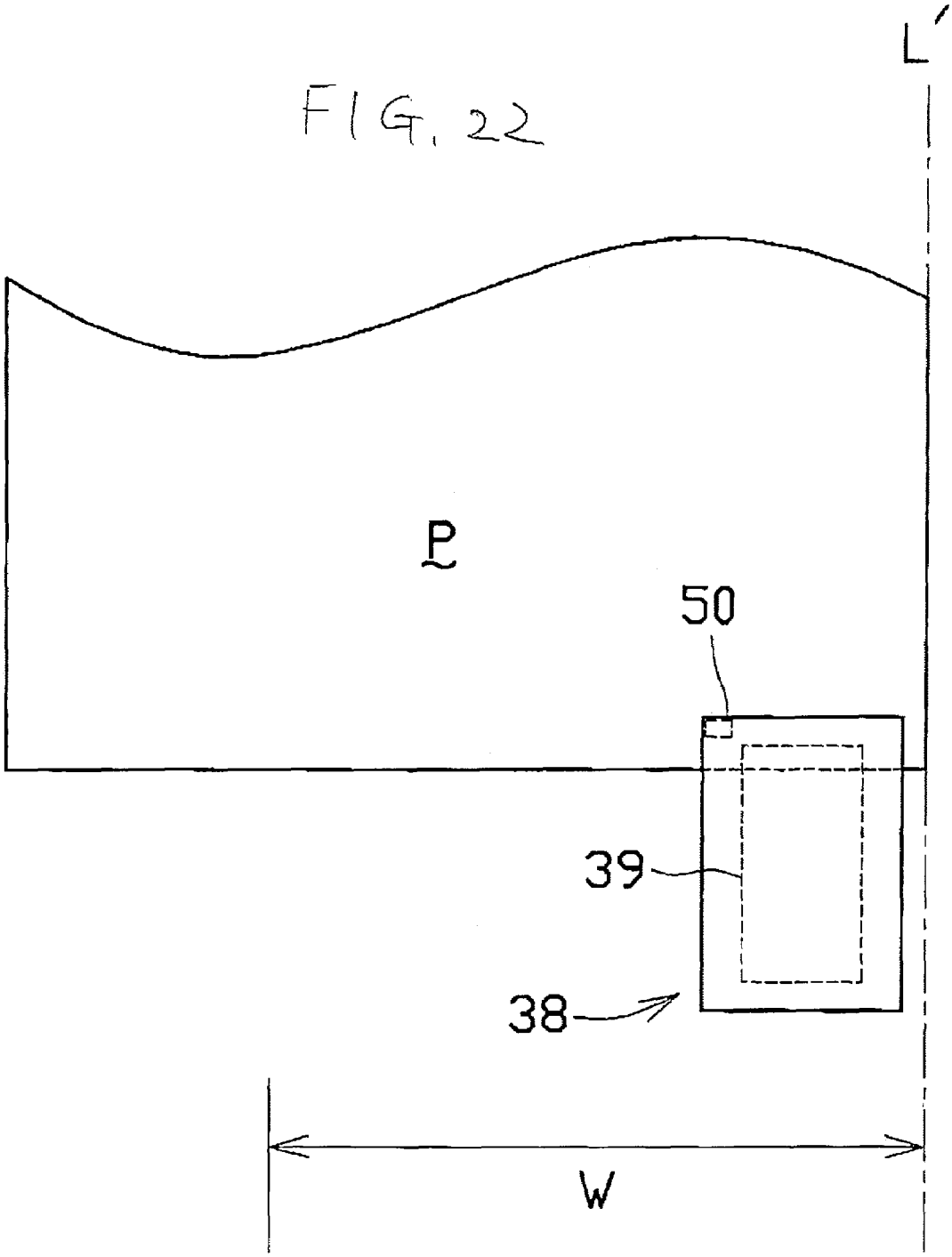
FIG. 22 is a plan view showing the position of the media sensor for adjusting the light intensity according to a modification.

In this modification, the light intensity adjustment of S302 performed in the width detection process shown in the flowchart of FIG. 13 is not performed by positioning the media sensor in the widthwise center of the paper, as in S301, but is performed by positioning the media sensor inside the recording paper 2 a prescribed distance from the reference line L', as shown in FIG. 22. When the recording paper P is conveyed with an edge along the reference line L', the recording paper P always passes through a side nearer the center of the conveying path 23 with respect to the reference line L', regardless the size of the recording paper P. Therefore, the position for adjusting the light intensity of the recording paper P is set within a region between the reference line L' and a position shifted from the reference line L' toward the center of the conveying path 23 by a width W of the smallest size paper that can undergo image recording on the multifunction device 1.

In this modification, in the trailing edge and leading edge detection operations performed in the flowchart of FIG. 16, the standby position for the carriage 38 (see FIG. 19) is set to the reference line L'. In other words, since the recording paper P of all sizes is conveyed with ore edge aligned with the reference line L', that side of the recording paper P is set as the standby position. In this way, the standby position of the carriage 38 can be fixed in order to reliably detect the leading edge of the next sheet of recording paper Pn, regardless the size of the next sheet of recording paper Pn.

What is claimed is:

1. An image-recording device comprising: a conveying portion that conveys a recording medium in a conveying direction; a carriage that reciprocates along a scanning direction orthogonal to the conveying direction; a recording head supported on the carriage, the recording head performing recording operations for recording an image on the recording medium; a sensor supported on the carriage at a position shifted from the recording head in the scanning direction and upstream of the recording head in the conveying direction, the sensor being capable of detecting presence of the recording medium; and an edge-detecting portion that controls the sensor to detect at least one of a leading edge and a trailing edge of a recording medium, wherein the carriage is configured to be capable of being placed in a standby position, such that the recording head is outside an area through which the recording medium passes and that the sensor is within the area through which the recording medium passes; and wherein the conveying portion conveys the recording medium with the carriage being placed in the standby position, while the edge-detecting portion detects at least one of the leading edge of the recording medium and the trailing edge of the recording medium.

2. The image-recording device as claimed in claim 1, wherein the edge-detecting portion detects positions of both edges of the recording medium in the scanning direction, and sets the standby position based on the detected positions of the both edges.

3. The image-recording device as claimed in claim 1, wherein the conveying portion conveys the recording medium such that one edge of the recording medium in the scanning direction moves along a reference line in parallel with the conveying direction; and wherein the standby position is set based on the one edge of the recording medium in the scanning direction.

4. The image-recording device as claimed in claim 1, wherein the conveying portion conveys, to a detection point of the sensor, a next recording medium on which an image is to be recorded before an image-recording process has been completed on a currently recording medium.

5. The image-recording device as claimed in claim 1, further comprising a recording medium detecting portion that detects passage of a recording medium, the recording medium detecting portion being disposed upstream of the carriage in the conveying direction, wherein, after the recording medium detecting portion detects that a currently recording medium has passed, the edge-detecting portion detects a trailing edge of the currently recording medium and a leading edge of a next recording medium on which an image is to be recorded, with the carriage being placed in the standby position.

6. The image-recording device as claimed in claim 1, wherein the recording head records an image on a currently recording medium within a range up to a trailing edge of the currently recording medium detected by the edge-detecting portion and records an image on a next recording medium on which an image is to be recorded within a range beginning from a leading edge of the next recording medium detected by the edge-detecting portion.

7. An image-recording device comprising: a conveying portion that conveys a recording medium in a conveying direction; a carriage that reciprocates along a scanning direction orthogonal to the conveying direction; a recording head supported on the carriage, the recording head performing recording operations for recording an image on the recording medium; a sensor supported on the carriage at a position shifted from the recording head in the scanning direction and upstream of the recording head in the conveying direction, the sensor being capable of detecting presence of the recording medium; and an edge-detecting portion that controls the sensor to detect at least one of a leading edge and a trailing edge of a recording medium, wherein the sensor includes a light-emitting element that irradiates light on a recording medium and a light-receiving element that receives light reflected off the recording medium.

8. The image-recording device as claimed in claim 7, wherein the edge-detecting portion detects an edge of a recording medium when the intensity of light received by the light-receiving element exceeds a threshold value.

9. The image-recording device as claimed in claim 8, further comprising: a left-and-right-edge detecting portion that controls the carriage to move in the scanning direction while detecting left and right edges of a recording medium with the sensor; a memory that stores a left and right edges data indicating positions of the left and right edge of the recording medium detected by the left and right edge detecting portion, distinguishing between a left and right edge data of a currently recording medium and a left and right edge data of a next recording medium on which an image is to be recorded; a recording medium determining portion that determines, after the detecting portion detects the trailing edge of the currently recording medium, whether the recording medium associated with the left and right edge data is the next recording medium, based on the detection of the leading edge of the next recording medium; and a controlling portion that controls the recording head to perform an image-recording operation on each recording medium based on the left and right edge data stored in the memory.

10. An image-recording device comprising: a conveying portion that conveys a recording medium in a conveying direction; a carriage that reciprocates along a scanning direction orthogonal to the conveying direction; a recording head supported on the carriage, the recording head performing recording operations for recording an image on the recording medium; a sensor supported on the carriage at a position shifted from the recording head in the scanning direction and upstream of the recording head in the conveying direction, the sensor being capable of detecting presence of the recording medium; a left-and-right-edge detecting portion that controls the carriage to move in the scanning direction while detecting left and right edges of a recording medium based on a detection signal from the sensor; a leading-and-trailing-edge detecting portion that controls the carriage to be placed in a standby position, at which position the recording head is outside an area through which the recording medium passes and the sensor is within the area through which the recording medium passes, the leading-and-trailing-edge detecting portion detecting leading and trailing edges of a recording medium based on a detection signal from the sensor when the conveying portion conveys the recording medium; a memory that stores a left and right edge data indicating positions of the left and right edge of the recording medium detected by the left-and-right-edge detecting portion, distinguishing between a left and right edge data of a currently recording medium and a left and right edge data of a next recording medium on which an image is to be recorded; a recording medium determining portion that determines, after the leading-and-trailing-edge detecting portion detects the trailing edge of the currently recording medium, whether the recording medium associated with the left and right edge data is the next recording medium, based on the detection of the Leading edge for the next recording medium; and a controlling portion that controls the recording head to perform an image-recording operation on each recording medium based on the left and right edge data stored in the memory.

11. The image-recording device as claimed in claim 10, wherein, after the recording head records a prescribed line feed amount of an image, the leading-and-trailing-edge detecting portion controls the carriage to be placed in the standby position.

12. The image-recording device as claimed in claim 10, wherein the leading-and-trailing-edge detecting portion sets the standby position based on detected positions of the left and right edges.

13. The image-recording device as claimed in claim 10, wherein the conveying portion conveys the recording medium such that either one of the left and right edges of the recording medium moves along a reference line in parallel with the conveying direction; and wherein the standby position is set based on the either one of the left and right edges of the recording medium.

14. The image-recording device as claimed in claim 10, wherein the conveying portion conveys, to a detection point of the sensor, a next recording medium on which an image is to be recorded before an image-recording process has been completed on a currently recording medium.

15. The image-recording device as claimed in claim 10, further comprising a recording medium detecting portion that detects passage of a recording medium, the recording medium detecting portion being disposed upstream of the carriage in the conveying direction, wherein, after the recording medium detecting portion detects that a currently recording medium has passed, the leading-and-trailing-edge detecting portion detects a trailing edge of the currently recording medium and a leading edge of a next recording medium on which an image is to be recorded, with the carriage being placed in the standby position.

16. The image-recording device as claimed in claim 10, wherein the recording head records an image on a currently recording medium within a range up lo a trailing edge of the currently recording medium detected by the edge-detecting portion and records an image on a next recording medium on which an image is to be recorded within a range beginning from a leading edge of the next recording medium detected by the edge-detecting portion.

17. The image-recording device as claimed in claim 10, wherein the sensor includes a light-emitting element that irradiates light on a recording medium and a light-receiving element that receives light reflected off the recording medium.

18. The image-recording device as claimed in claim 17, wherein the edge-detecting portion detects an edge of a recording medium when the intensity of light received by the light-receiving element exceeds a threshold value.

* * * * *